US012397200B2

(12) United States Patent
Small

(10) Patent No.: US 12,397,200 B2
(45) Date of Patent: Aug. 26, 2025

(54) ISOKINETIC CONTROL MODULE AND METHOD FOR STRENGTH TRAINING WITH USER-GENERATED RESISTANCE AND GRAPHICAL FORCE DISPLAY

(71) Applicant: Poseidon Strength, LLC, Mechanicsburg, PA (US)

(72) Inventor: Mark Small, Mechanicsburg, PA (US)

(73) Assignee: Poseidon Strength, LLC, Mechanicsburg, PA (US)

( * ) Notice: Subject to any disclaimer, the term of this patent is extended or adjusted under 35 U.S.C. 154(b) by 299 days.

(21) Appl. No.: 17/933,517

(22) Filed: Sep. 20, 2022

(65) Prior Publication Data

US 2023/0110120 A1 Apr. 13, 2023

Related U.S. Application Data

(60) Provisional application No. 63/254,236, filed on Oct. 11, 2021.

(51) Int. Cl.
*A63B 24/00* (2006.01)
*A63B 21/00* (2006.01)
(Continued)

(52) U.S. Cl.
CPC .... *A63B 24/0087* (2013.01); *A63B 21/00069* (2013.01); *A63B 21/002* (2013.01);
(Continued)

(58) Field of Classification Search
None
See application file for complete search history.

(56) References Cited

U.S. PATENT DOCUMENTS 3,465,592 A * 9/1969 Perrine ..... A63B 21/0083 482/5
4,544,154 A * 10/1985 Ariel ..... A63B 24/00 482/901

(Continued)

FOREIGN PATENT DOCUMENTS

CN 111870902 A 11/2020
DE 102011110177 * 2/2013

(Continued)

OTHER PUBLICATIONS

EGym Products: www.egym.com.
Speede Gym Products: www. speede.fit.

*Primary Examiner* — Shila Jalalzadeh Abyaneh
(74) *Attorney, Agent, or Firm* — Hilary J. Sumner

(57) ABSTRACT

An isokinetic control module and method for incorporation on both new and existing exercise equipment. The control module replaces standard friction and hydraulic resistance components offering constant speed of the moveable elements of the machine rather than a selected resistance or weight. The constant user-generated resistance prevents injury and enhances strength training of the targeted muscle groups by maintaining constant strain on those muscles throughout the exercise. This method and device incorporates both a PCFC valve and a check valve device, removing all resistance the moment the user stops applying force to the machine. This enhances safety and facilitates the rapid return of the lifting element to its home position between repetitions. An optional graphical display is also disclosed.

5 Claims, 21 Drawing Sheets

(51) Int. Cl.
*A63B 21/002* (2006.01)
*A63B 21/008* (2006.01)
*A63B 71/06* (2006.01)

(52) U.S. Cl.
CPC ..... *A63B 21/0083* (2013.01); *A63B 24/0062* (2013.01); *A63B 71/0622* (2013.01); *A63B 2024/0093* (2013.01); *A63B 2071/0675* (2013.01); *A63B 2220/56* (2013.01); *A63B 2220/833* (2013.01)

(56) References Cited

U.S. PATENT DOCUMENTS 4,869,498 A * 9/1989 Wolf ..... A63B 22/0076 482/73
5,005,140 A 4/1991 Havriluk
5,054,774 A * 10/1991 Belsito ..... A63B 24/00 715/784
7,762,934 B1 * 7/2010 Munson, Jr. ..... A63B 21/4045 482/112
2002/0091038 A1 7/2002 Johnston et al.
2005/0049122 A1 3/2005 Vallone, Jr. et al.
2013/0165825 A1 6/2013 Carrillolopez et al.
2016/0144239 A1 5/2016 Sclafini et al.
2017/0028246 A1 * 2/2017 Vorozilchak ..... A63B 21/4029
2019/0175972 A1 * 6/2019 Small ..... A63B 21/157
2021/0023416 A1 1/2021 Yu et al.

FOREIGN PATENT DOCUMENTS

DE 102011110177 A1 * 2/2013 ..... A63B 21/008
EP 0279052 A1 * 8/1988
KR 102084628 B1 3/2020
WO WO 2002043815 A1 6/2002
WO WO 2021032848 A1 2/2021

* cited by examiner

ISOKINETIC CONTROL MODULE AND METHOD FOR STRENGTH TRAINING WITH USER-GENERATED RESISTANCE AND GRAPHICAL FORCE DISPLAY

CROSS REFERENCE TO RELATED APPLICATIONS

This application claims benefit of priority from U.S. Provisional Patent Application No. 63/254,235 of Mark Small, filed Oct. 11, 2021, entitled HYSTERETIC ISOKINETIC CONTROL MODULE & METHOD FOR STRENGTH TRAINING WITH GRAPHICAL FORCE DISPLAY, the entirety of which is incorporated herein by reference.

STATEMENT REGARDING FEDERALLY SPONSORED RESEARCH/DEVELOPMENT

Not Applicable

PARTIES TO A JOINT RESEARCH AGREEMENT

Not Applicable

REFERENCE TO SEQUENCE LISTING, TABLE OR COMPUTER PROGRAM

Not Applicable

BACKGROUND OF THE INVENTION

Resistance training offers an effective means for developing strength and building muscle tissue. The efficacy of any exercise is governed by the resistance applied to the body. Exercise machines traditionally require the user to move a fixed resistance or weight through a particular range of motion (ROM). The resistance or load applied to the athlete's body will vary depending on the location of the body during the ROM.

While exercise equipment allows the user to select a desired weight or resistance, neither free weights nor standard friction, pneumatic, or hydraulic resistance mechanisms deliver adaptive user-generated resistance throughout the ROM of a given exercise. Anatomical variation and changing loads throughout the workout lead to overdevelopment of some muscle groups and underdevelopment of others. Those who set the equipment at a high resistance or users who make explosive movements may sustain injury at points within the ROM.

As muscles contract to move a limb or limbs, it is the length of those limbs along with the weight or resistance selected that determines the actual force applied to the body. The longer the limb, the greater the moment or torque exerted on that limb. To illustrate this concept, consider a ten pound weight connected to one end of a rod. A person will find it much easier to lift the rod closer to the load than to pick it up at the rod's opposing end. The nature of leverage makes the exercise feel more challenging the farther one lifts from the weight. The load has not changed but the moment is greater when the rod is lifted at its far end. This concept applies to simple exercises such as bicep curls where a weight is held by the hand and moved in an arc toward the body. The elbow acts as a fulcrum and the resistance or perceived weight varies throughout the travel of that exercise, feeling heavier when the arm is outstretched than when it is closest to the body.

In more complex exercises such as a dead lift, the knees, hips, and ankle joints each act as a fulcrum, further changing the leverage or resistance exerted on the individual's muscles throughout the ROM. The load or weight in this case is the weight of the lifter's body in addition to free weights the individual is holding or, alternatively, the resistance applied by a machine. Picking a weight directly off the floor or from an extended starting position may result in injury. As in the example of the bicep curl, the resistance applied to the body at any given point in time will vary depending on where the body is positioned in the ROM for that exercise.

The physical stature of the person exercising also affects the level of resistance throughout the motion. In a squat for instance, the longer the femur, the greater the distance between the load and the fulcrum, and consequently, the more difficult it is to move a given amount of weight. This means that a shorter person has a body that is better adapted for squats and that individual may therefore exercise more efficiently in that particular ROM.

Free weights and existing fitness equipment fail to address the inherent problem of varying torque throughout the ROM and do not account for anatomical variation in individuals performing the selected exercise. Because the resistance varies throughout the routine, the athlete may struggle to maintain a safe form under increased weight and release of that weight may lead to injury in an emergency. Additionally, a great deal of time is often spent adjusting the load as standard weight increments are typically no smaller than five pounds. As a result, athletes are forced to select a predetermined weight at which they are prepared to fail rather than a desired machine speed where the equipment matches exerted force with an instantaneous opposing resistance to maintain a consistent velocity during the ROM.

There is therefore a need in the art for exercise equipment that addresses variation in anatomy, provides consistent speed and instantaneously adaptive user-generated resistance to the exerciser throughout the entire ROM, and permits more granular adjustment of machine speed for more effective exercise.

BRIEF SUMMARY OF THE INVENTION

There is a growing trend in exercise known as isokinetics. This is a strength training method that blends the intense muscular contractions experienced in isometric exercise with the full ROM required in isotonic workouts. True isokinetic machines require each targeted muscle group to work against an adaptive user-generated resistance that maintains a constant velocity throughout the entire path of the exercise (hereinafter "user-generated resistance"). The present invention provides a means for achieving this type of workout through dead lift, squat, bench press, abdominal, and latissimus dorsi (lat) machines among others. A specialized hydraulic system is connected to the user driven element(s) of the machine. This system maintains a constant fluid flow throughout the exercise stroke and facilitates a user-generated resistance that opposes the force applied at the user driven element at any given moment in time.

It is an object of the invention to provide an isokinetic module and method for delivering constant speed or velocity within a piece of exercise equipment while storing no detectable energy within that system. This allows the user to release the machine without fear of injury.

Typical free weight and pneumatic exercise machines require the user to pre-select a weight or resistance based on their perceived maximum ability. The athlete may under or overestimate their physical capacity when they exercise to failure. Sudden movement or inconsistent speed changes within the ROM may result in injury, and some amount of energy remains in the machine where it may cause further injury. This is completely avoided by using the present module and method. The isokinetic control module allows the user to dial in a desired speed while applying as much force as they wish throughout the ROM. The speed at which the user-driven element moves in any given piece of exercise equipment will be determined by the selected speed level; the athlete will not be able to make sudden movements or accelerations that result in injury nor will potential energy be retained in the module regardless of the force applied. In addition, the module and method places the athlete's muscles in a constant state of strain and contraction throughout the entire exercise. Primary and secondary muscle groups are activated, accelerating muscle fatigue and assisting in the break down and subsequent rebuilding of stronger muscle tissue. The athlete may give everything he or she has in every repetition without fear of injury.

The present invention is comprised of a closed loop hydraulic system having a piston within a hydraulic cylinder capable of generating fluid flow and in fluid communication with a device that controls and regulates the velocity of fluid within the system (said device hereinafter referred to as the PCFC unit). In one embodiment, the PCFC unit is comprised of a pressure compensated flow control valve (PCFC valve) with a speed adjustment mechanism, a PCFC valve inlet, a manifold, and a reverse flow check valve.

In another embodiment the reverse flow check valve is removed and the PCFC valve further comprises a check spool or sleeve and a corresponding spring or similar directional flow device (such valve shall hereinafter be referred to as a PCFC-RC valve) that opens to allow unrestricted fluid flow when the flow direction within the PCFC unit reverses. If the application requires the user driven element to return to its home position more quickly, a third embodiment comprising a PCFC unit that includes both a PCFC-RC valve and a reverse flow check valve may be used.

The rate of fluid flow during the exercise stroke within each of these embodiments is modified prior to working out through the speed adjustment mechanism which can be manually or electronically adjusted. As noted above, a reverse flow check valve, PCFC-RC valve, or combination of the two is used to facilitate unrestricted fluid flow during the return stroke, allowing the user driven element to return to its home position more rapidly in preparation for the next repetition.

A piston within the cylinder is attached to the user-driven element of the exercise equipment. In a dead lift machine, for instance, the piston is connected to the lifting arm of the machine. As the athlete pulls in an upward stroke, the piston extends within the hydraulic cylinder which initiates flow of fluid within the closed hydraulic system. Fluid travels into the first end of the PCFC unit. A flow regulating pressure compensating spool within the PCFC unit ensures that the flow remains substantially constant regardless of any fluctuations within the hydraulic system. It should be recognized that the valve industry commonly refers to valves offering "constant" fluid flow; however, the variable nature of these hydraulic systems results in fluid flow that is "measurably inconstant" and physically discernable by the user. For the purposes of this application "substantially constant fluid flow" is defined such that changes of the fluid flow within the present invention are physically undetectable by the individual using the system. With this in mind, the fluid flow and subsequent difficulty level of the workout will remain substantially constant regardless of the force the athlete applies to the lifting arm of the machine. In other words, the arm cannot be lifted any faster than the selected flow rate within the system will allow during the exercise stroke no matter how hard the athlete pulls on it. By creating this substantially constant fluid flow, the machine taxes both primary and secondary muscle groups evenly throughout the ROM of the exercise. Movement of the piston throughout the exercise and return strokes causes fluid to flow into and out of the cylinder, thereby pushing fluid into and out of the PCFC unit during each stroke cycle.

The machine's lifting arm is lowered during the return stroke, forcing the piston back into the cylinder. This process reverses the flow of fluid within the closed hydraulic system. Liquid within the closed hydraulic loop is forced through the second end of the PCFC unit or, in the case of a one port cylinder, movement of the piston may withdraw fluid from the first end of the PCFC unit. The reverse check flow valve in fluid communication with the PCFC valve via a manifold (or alternatively a PCFC-RC as described above) allows fluid to bypass the flow regulating pressure compensating spool within the PCFC valve such that the user-driven arm can return to its home position quickly.

Ideally, the closed loop hydraulic system is comprised of a two port cylinder or alternatively, a one port cylinder having a breather valve or similar component that allows movement of the piston within the cylinder. The system is designed such that there are no pockets of free air within the closed loop. An accumulator may be added to ensure uniform displacement of fluid within the system.

It is a further object of this invention to offer a method and device for monitoring and displaying the force applied by the user over the ROM of the exercise without having to measure the position of the user driven element. Typically, to graph force versus travel, one measures the force and the position of a sensor within a system. Because the fluid flow rate within the system is substantially constant, the need to measure the position of a sensor is eliminated. A pressure transducer may be introduced into the closed loop hydraulic system to determine the force generated by the user. This transducer measures the pressure of the fluid before it enters the PCFC unit and the pressure exerted over the ROM is converted to a signal by a data acquisition device or system (hereinafter DAQ). These signals are sent from the DAQ to a computer. A program within the computer creates a graphical representation of the workout and may calculate any number of statistical outputs based on force over time such as the maximum and average force applied during the workout. The data applying to each lift or cycle of the machine is sent to a display screen, allowing the user to visualize physical performance over a series of repetitions.

As previously mentioned, the dynamic nature of the machine maintains a consistent tension or force on the targeted muscles. Because the fluid velocity within the system remains constant regardless of the force applied, the risk of injury is significantly reduced making this an ideal means for rehabilitation of injured or compromised muscles. The self-contained and modular nature of the isokinetic module and method allows it to replace the standard stacked weights and inconsistent pneumatic and hydraulic resistance mechanisms currently employed on exercise equipment. Ultimately, this provides a more controlled and cost effective means to achieve isometric exercise.

REFERENCE NUMERALS

Figure 1A:
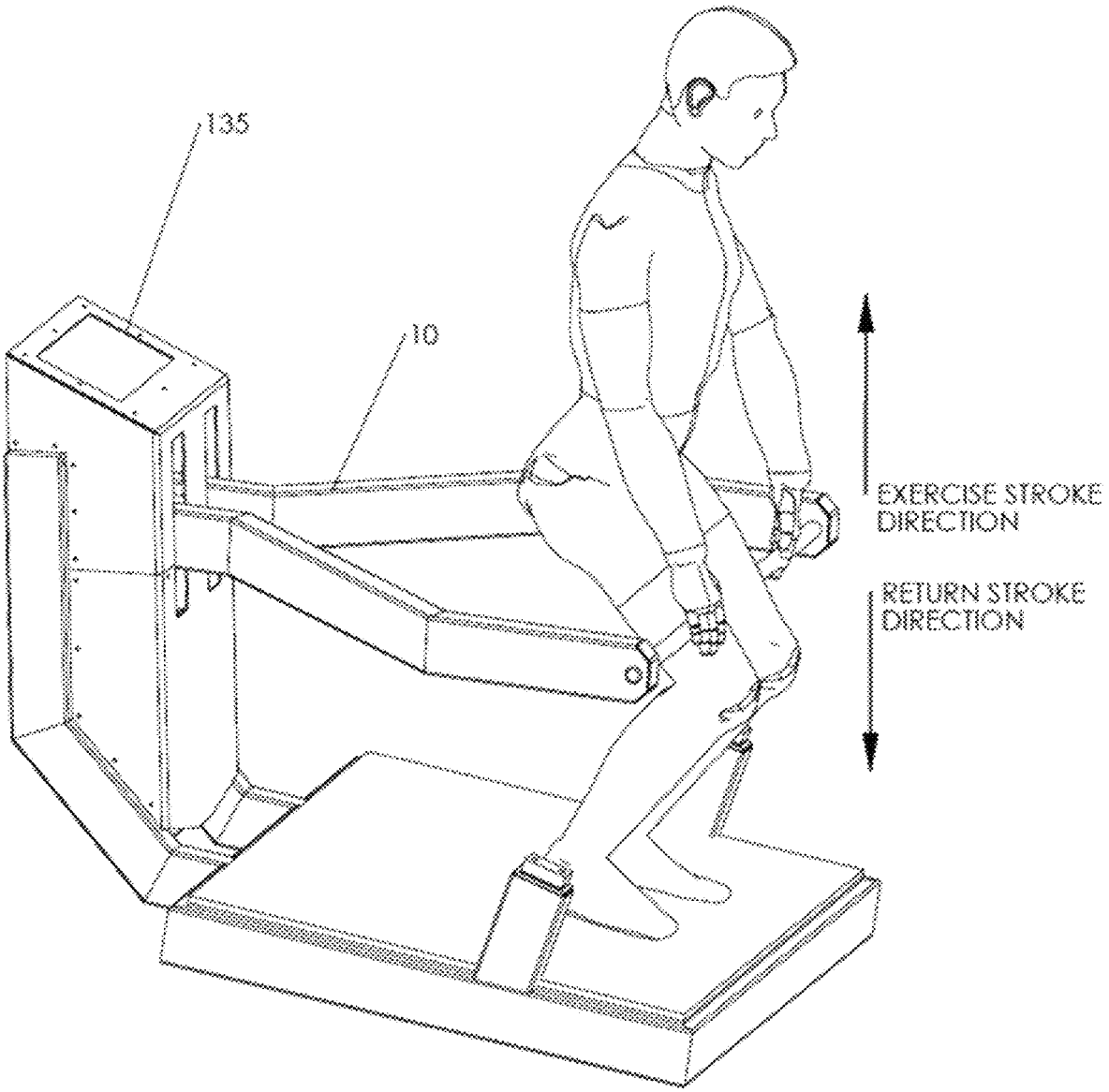
FIG. 1A is a front perspective view of a piece of exercise equipment where the arrows illustrate both the exercise and return stroke directions in a dead lift machine.

5 Isokinetic Flow Control Module/Mechanism
10 User Driven Element/Lifting Arm
15 Closed Loop Hydraulic System
20 Hydraulic Cylinder
25 Hydraulic Piston Unit
30 PCFC Unit
35 Fluid
40 Hydraulic Tubing
45 Upper Port of Hydraulic Cylinder
50 Lower Port of Hydraulic Cylinder
55 Piston
60 Top Rod of Piston
65 Manifold
70 Reverse Flow Check Valve
72 PCFC valve Inlet/PCFC-RC Valve Inlet
75 PCFC valve/PCFC-RC Valve
80 Tee/PCFC valve outlet
85 Accumulator
90 Accumulator Piston
95 Pressurized Inert Gas
100 Charge Port
105 Bottom Rod of Piston
110 Valve Adjustment Shaft
120 Restriction Mechanism
125 Compensator Spool
128 Breather Valve
130 Speed Adjustment Mechanism
135 Touch Screen
140 Pressure Transducer
145 Data Connection (from Pressure Transducer to DAQ)
150 Data Acquisition Device or System (DAQ)

DETAILED DESCRIPTION OF THE INVENTION

In this patent application, the moveable portion of an exercise machine defining the ROM of a particular movement shall be referred to as a "user driven element," "arm," or "lifting arm." It should be noted that more than one user driven element or lifting arm may exist on any given piece of exercise equipment. Pipe, conduit, and tubing capable of withstanding the pressures within the closed loop hydraulic system contemplated herein shall be referred to as "hydraulic tubing." While inventor contemplates the use of oil in the closed loop hydraulic system, the term "fluid," as used in this application, shall mean any incompressible liquid.

Exercise equipment generally has an "exercise stroke" wherein the user driven element 10 is moved in one direction to tax a targeted group of muscles. The equipment also has a "return stroke" wherein the user driven element 10 moves in the opposite direction and either allows the user's muscles to recover or, alternatively, exercises a different group of muscles. It should be recognized that the direction of flow in a given application will depend on how the module is connected to the user driven element.

One object of the present invention is to create a family of exercise machines by mounting an isokinetic flow control mechanism 5 (hereinafter "mechanism") to the user driven element(s) 10 of the respective equipment. The substantially constant flow of fluid within this mechanism 5 translates to instantaneously adaptive user-generated resistance throughout the specific ROM linked to the user driven element 10. The mechanism 5 prohibits the exerciser from moving the user driven element 10 faster than the selected speed during the exercise stroke, regardless of the force applied.

Another object of the invention is to offer a device and method that provides resistance to the user only when that user is applying force to the machine in which it is connected ("user-generated resistance"). The moment that user relaxes, the machine returns to its home position, gently but rapidly preparing for the next repetition. The immediate release of resistance enhances safety particularly when the user is feeling exhausted by the exercise.

While inventor anticipates the creation of multiple species of exercise equipment incorporating this mechanism 5, it should be recognized that one may also upgrade friction based or standard hydraulic resistance units in existing machines with the mechanism 5 described herein. Replacement of these standard resistance methods will result in a safer and more efficient means of exercising the selected muscle group(s) by offering a constant speed and subsequent instantaneous and adaptive user-generated resistance rather than a mechanism that can be overcome with additional force.

Figure 1B:
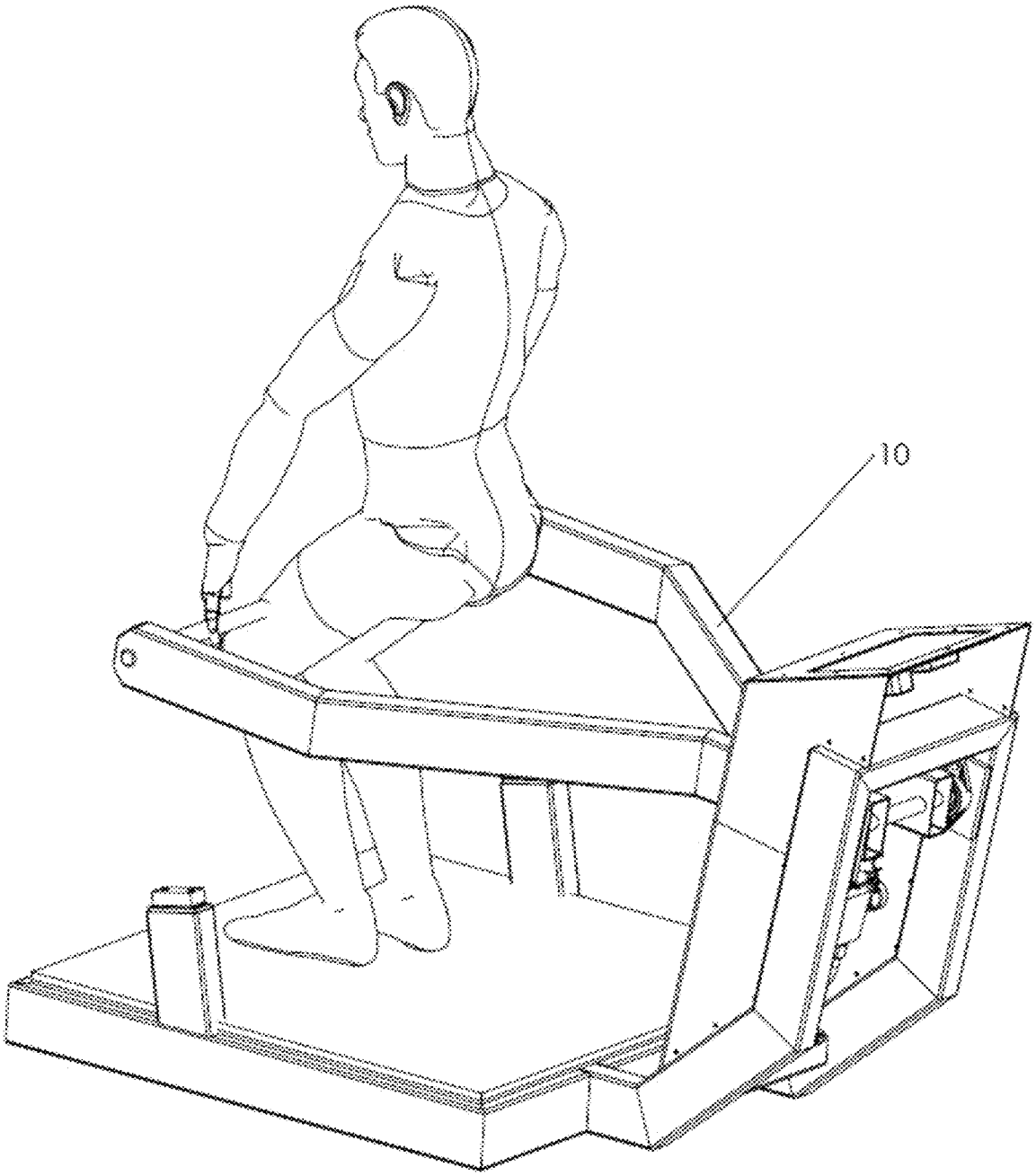
FIG. 1B is a rear respective view of a deadlift machine showing the isokinetic closed loop hydraulic system connected to the lifting arm of the equipment.
Figure 2:
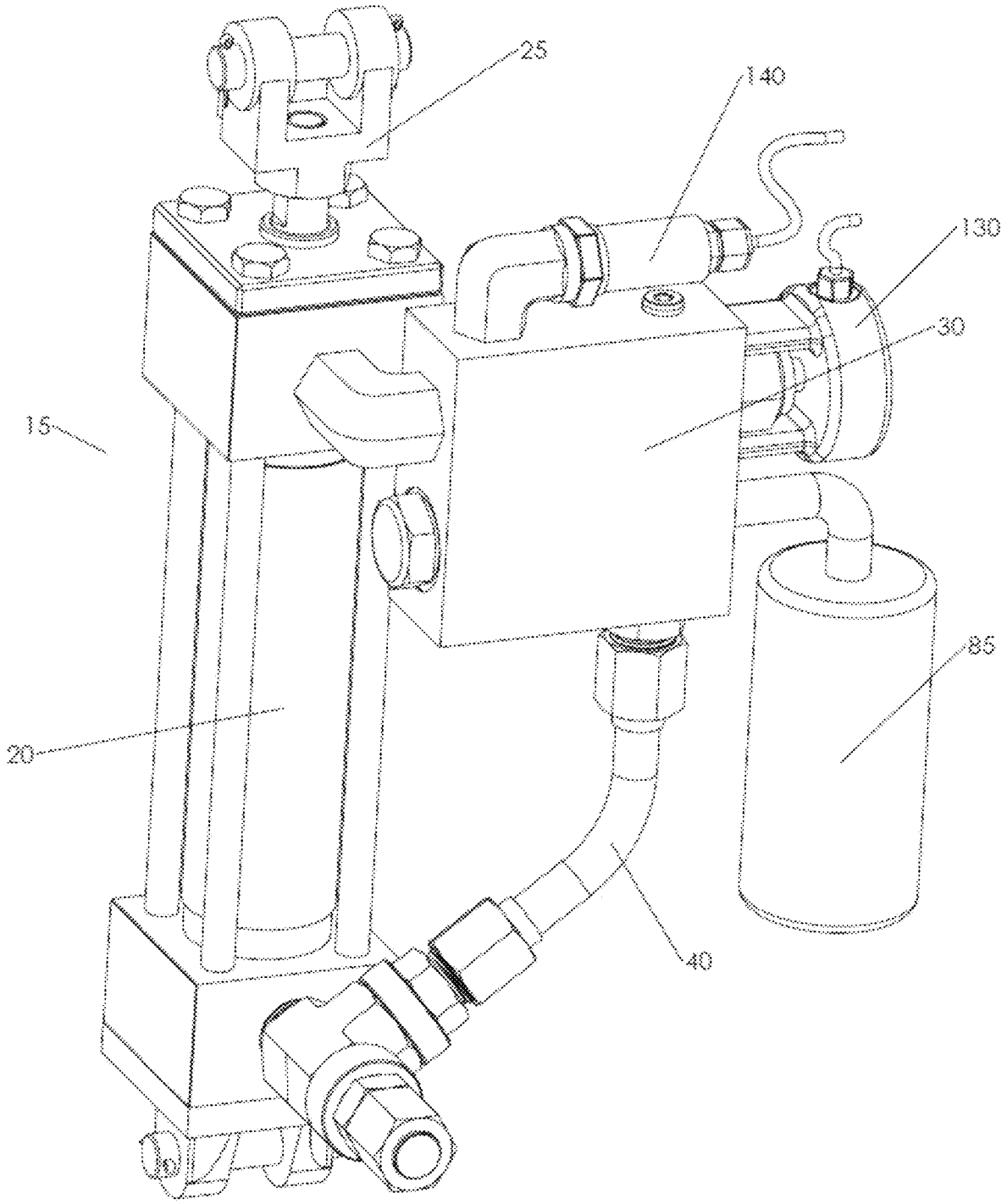
FIG. 2 is a perspective view of the isokinetic flow control module showing the optional accumulator.

FIGS. 1A and 1B depict a dead lift machine wherein the person exercising lifts a bar or arm. This bar or arm comprises the user-driven element 10. Referring now to FIG. 2, the isokinetic flow control mechanism 5 is comprised of a substantially air-free closed loop hydraulic system 15 having a hydraulic cylinder 20 (hereinafter "cylinder"), a hydraulic piston unit 25, a PCFC unit 30, fluid 35, hydraulic tubing 40, an optional pressure transducer 140, and an optional accumulator 85 as described below. The mechanism 5 is primed such that a negligible amount of air remains in the system making it "substantially air free." Any air remaining in the system is undetectable through standard measurement techniques.

Figure 3A:
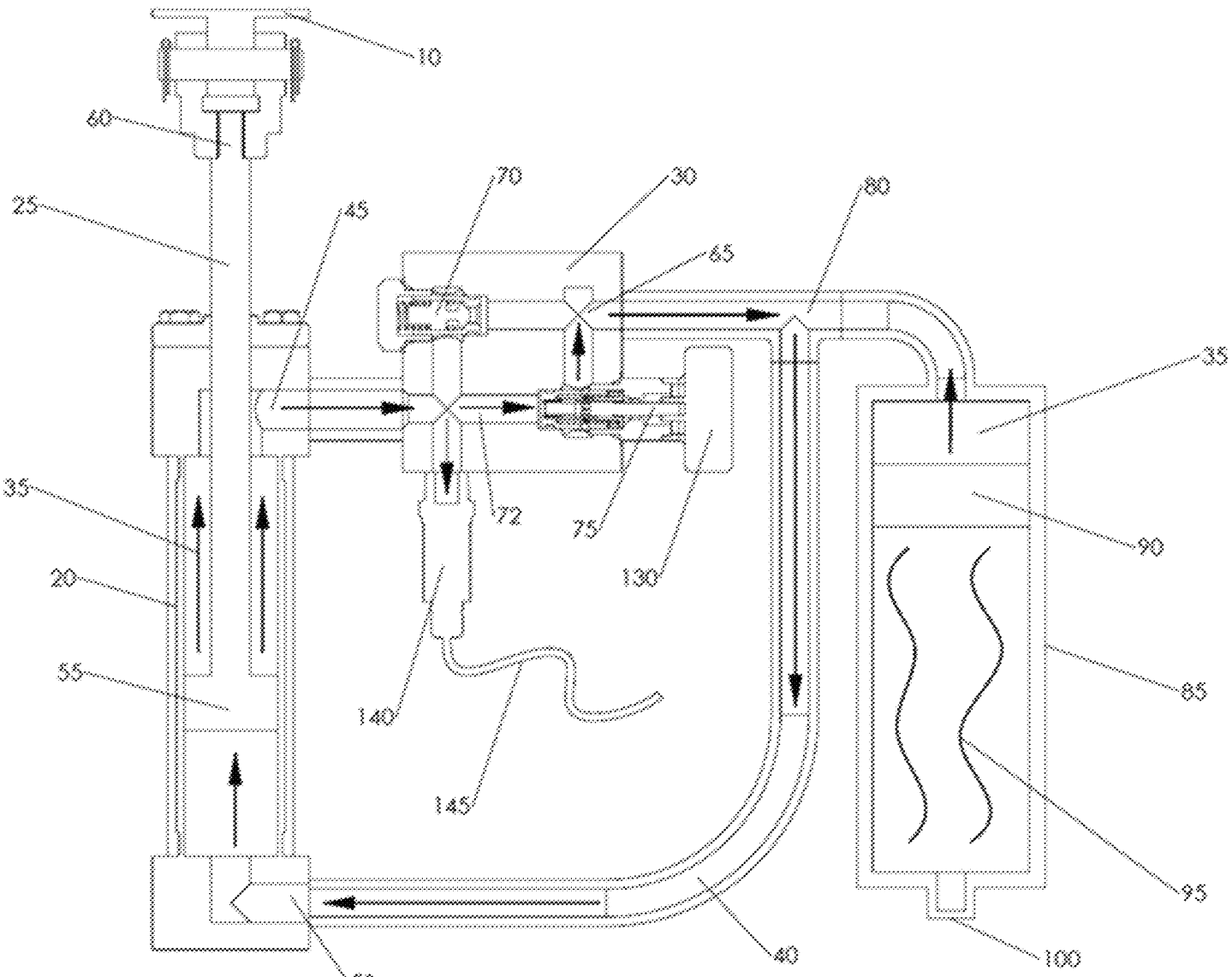
FIG. 3A is a detailed cross sectional view of the isokinetic flow control module having an accumulator where the arrows illustrate fluid flow during an exercise stroke.
Figure 3B:
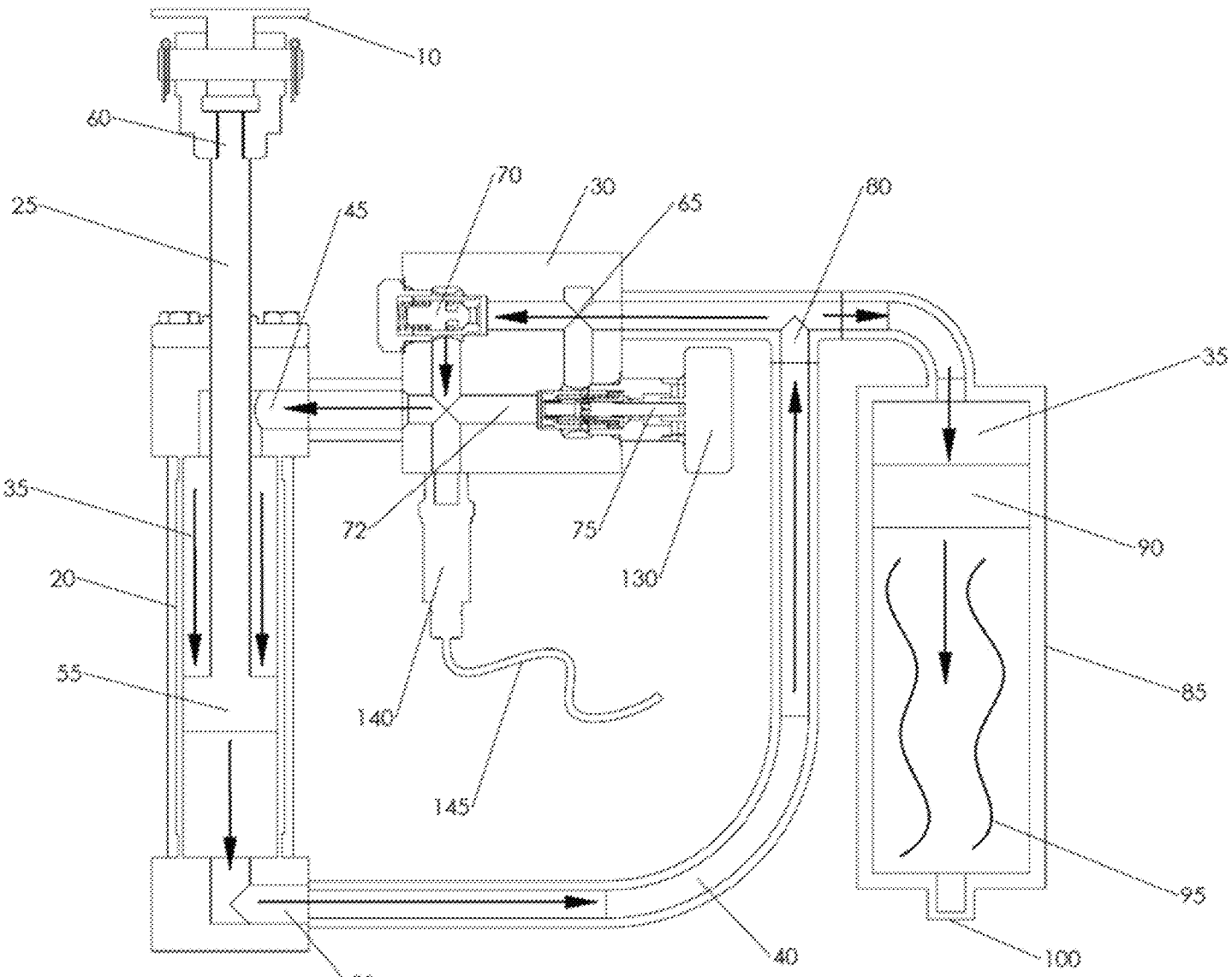
FIG. 3B is a detailed cross sectional view of the isokinetic flow control module having an accumulator where the arrows illustrate fluid flow during a return stroke.

In one embodiment, illustrated in FIGS. 2, 3A, and 3B, the cylinder 20 has an upper port 45 and a lower port 50 to allow for the forward and reverse flow of fluid 35 within the closed loop hydraulic system 15. The piston 55 within the hydraulic piston unit 25 fits snugly and moves within the cylinder 20 while the top rod 60 of the hydraulic piston unit 25 is mechanically fastened to the user driven element 10 of the exercise machine.

The heavy arrows in FIG. 3A illustrate the fluid flow 35 within the mechanism 5 during an exercise stroke. In a deadlift machine for instance, the athlete pulls on the user driven element 10, applying an upward force to the top rod 60 of the hydraulic piston unit 25. Movement of the piston 55 within the cylinder 20 pushes fluid 35 above that piston 55, out the upper port 45, and into the PCFC unit 30. The reverse flow check valve 70 may either be in fluid communication with the PCFC valve inlet 72 or it may be integral to the PCFC valve. Said reverse flow check valve 70 has a spring-backed piston or similar mechanism that remains closed when fluid enters near the PCFC valve inlet 72. This ensures that fluid 35 is directed to the PCFC unit 30.

In the embodiment shown in FIGS. 2, 3A and 3B, the PCFC unit 30 is comprised of a manifold 65, a reverse flow check valve 70, a PCFC valve inlet 72, and a PCFC valve 75. Because the system is full of fluid 35 and substantially air-free, force on the user driven element 10 propels fluid 35 above the piston 55 up and out of the upper port 45 of the cylinder 20 and into the PCFC valve inlet 72 of the PCFC unit 30. A reverse flow check valve 70 in fluid communication with both the PCFC valve inlet 72 and manifold 65 directs fluid 35 into the PCFC valve 75. The PCFC valve 75 permits only a predetermined quantity of fluid 35 to flow through it at any given instant in time regardless of how hard the user pulls on the user driven element 10. A more detailed description of the path of flow within the PCFC unit 30 is provided below. Fluid 35 exits the PCFC valve 75 and enters the manifold 65 where it exits the PCFC unit 30 and returns through the hydraulic tubing 40 into to the lower port 50 of the cylinder 20.

The heavy arrows in FIG. 3B illustrate the fluid flow 35 in a return stroke of the exercise equipment in this same embodiment. At the end of the exercise stroke, the user returns the user driven element 10 to its home position readying the machine for the next repetition. In a dead lift machine for example, weight of the user driven element 10 exerts a downward force on the top rod 60 of the hydraulic piston unit 25 when released. This force pushes that piston 25 into the cylinder 20, reducing the volume of fluid 35 beneath the piston 55 within that cylinder 20. It should be noted that movement of the user driven element 10 will be determined by the orientation of that component and the return stroke may not necessarily be in a downward movement depending on the type of exercise machine being used; such movement may be horizontal, vertical, arcuate, linear, or pendular in nature.

During the return stroke of this embodiment, the movement of the hydraulic piston unit 25 within the cylinder 20, drives fluid 35 below the piston 55 out of the lower port 50. Fluid 35 subsequently flows in a reverse path to that described in the exercise stroke. Pressure within the system drives fluid 35 within the manifold 65 into the reverse flow check valve 70. This reverse flow check valve 70 uses a spring-backed piston that opens when fluid 35 enters the bottom of said valve 70; this allows fluid 35 to flow into the upper port 45 of cylinder 20 above the piston 55. By bypassing the PCFC valve 75, the user driven element 10 can be quickly returned to its home position.

One should note that the top rod of the piston 60 displaces fluid; the position of the top rod within the cylinder consequently displaces fluid at a different rate above the piston than it displaces below it. While there is a negligible amount of air in the system, all fluid traps some quantity of air by its nature. As the piston extends and retracts, the minute quantity of air within the system compresses or expands respectively. This may lead to an undesired suction within the system, undermining the function of the machine.

In a return stroke for example, the volume of fluid beneath the piston 55 will increase at a faster rate than the volume of fluid 35 decreases above that piston 55. This disparity in the rate of volumetric changes throughout the stroke creates suction. An optional tee 80 and accumulator 85 may be added to the closed loop hydraulic system 15 to compensate for this disparity as shown in FIGS. 3A and 3B. This tee 80 allows any excess fluid 35 within the hydraulic tubing 40 to flow into the accumulator 85.

The accumulator 85 is comprised of an accumulator piston 90 supported by an inert pressurized gas 95 such as nitrogen. This inert pressurized gas 95 exerts a constant force on the accumulator piston 90 that inversely increases as the volume beneath the accumulator piston 90 decreases. An optional charge port 100 may be mounted beneath the accumulator 85 to allow for periodic recharging of the inert pressurized gas 95 as needed.

A given quantity of fluid 35 is stored above the accumulator piston 90 at any instant in time. As the volume of fluid 35 below the piston 55 increases, the accumulator piston 90 moves upward, pushing the stored fluid 35 through the tee 80 and down toward the lower port 50 of the hydraulic cylinder 20. See FIG. 3A. As the volume of fluid 35 below the cylinder 20 decreases, the accumulator piston 90 shifts downward, taking on more fluid 35 above said piston 90 for the next exercise cycle. See FIG. 3B.

Figure 4A:
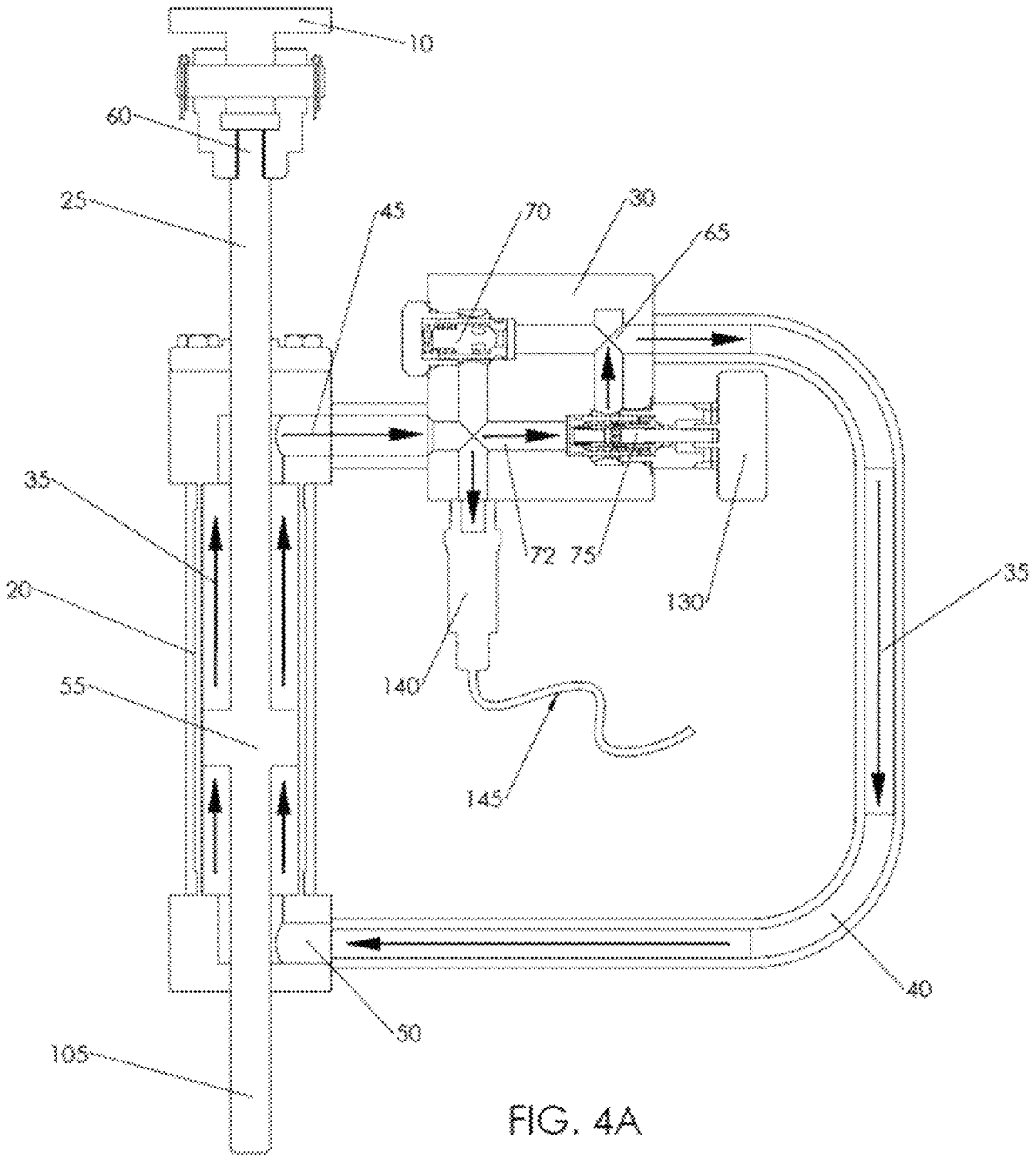
FIG. 4A is a detailed cross sectional view of the isokinetic flow control module having a bottom rod in lieu of an accumulator where the arrows illustrate fluid flow during an exercise stroke.
Figure 4B:
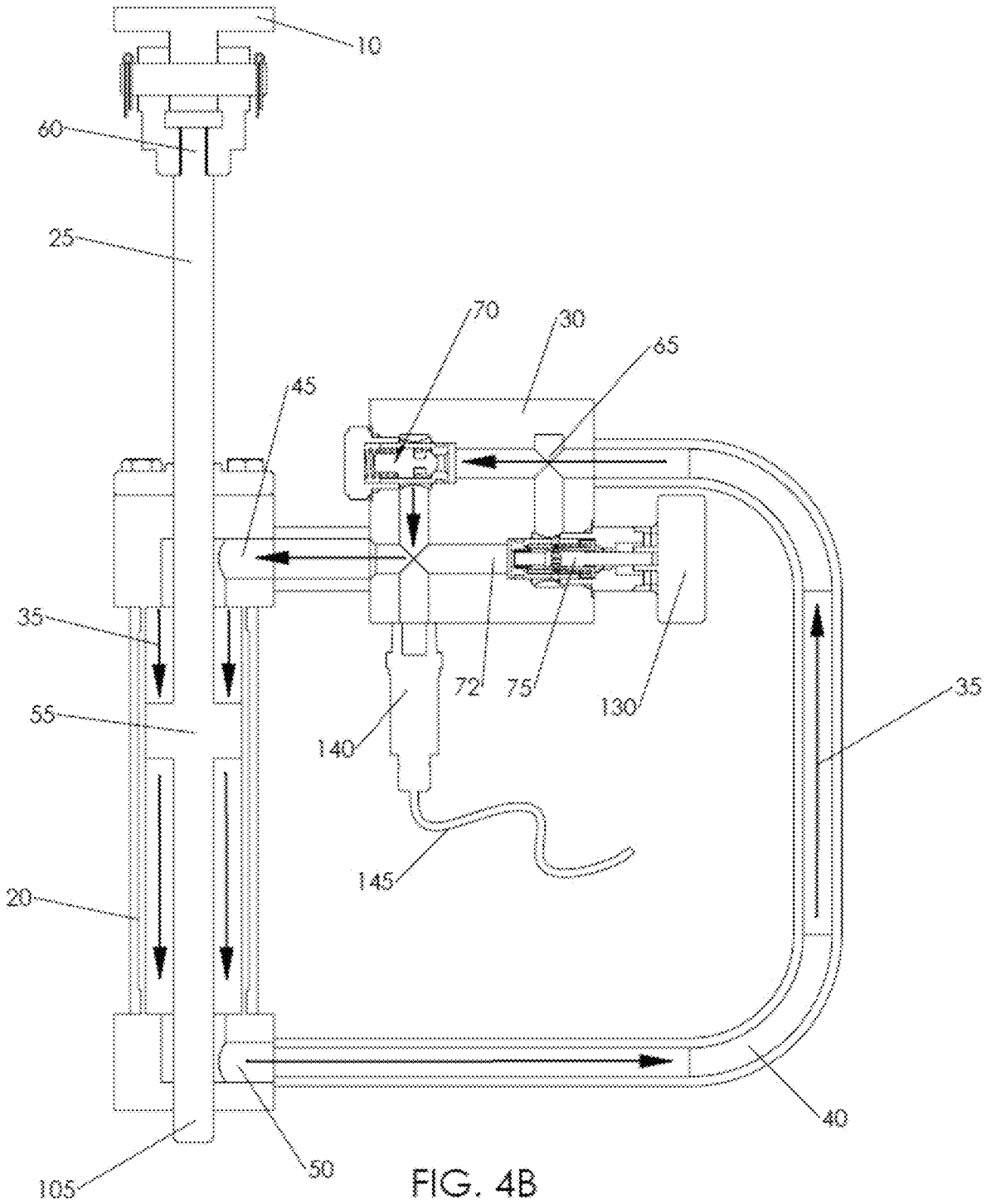
FIG. 4B is a detailed cross sectional view of the isokinetic flow control module having a bottom rod in lieu of an accumulator where the arrows illustrate fluid flow during a return stroke.

While FIGS. 3A and 3B illustrate one embodiment using a standard cylinder and piston with an accumulator 85 to address the volume disparity above and below the piston 55, FIGS. 4A and 4B illustrate an alternate embodiment employing a cylinder 20 having a bottom rod 105 to offset these differences volumetrically. The heavy arrows in FIG. 4A illustrate the fluid flow 35 during the exercise stroke of a given piece of exercise equipment. As with the first embodiment, the athlete moves the user driven element 10, applying force to the top rod 60 of the hydraulic piston unit 25. Movement of the hydraulic piston unit 25 within the cylinder 20 pushes the fluid 35 above the piston 55, up and out of the upper port 45 and into the inlet 72 of the PCFC unit 30. The reverse flow check valve 70 directs fluid 35 into the PCFC valve 75 in the same manner as in the first embodiment, the valve 75 allowing only a regulated quantity of fluid 35 to flow through it at any given instant in time regardless of the force applied to the user driven element 10. Fluid 35 leaves the PCFC valve 75 as in the previous embodiment shown in FIG. 3A, entering the manifold 65 where it exits the PCFC unit 30 and returns through the hydraulic tubing 40 into the lower port 50 of the cylinder 20. As in the previous embodiment, the fluid flow rate and subsequent instantaneous user-generated resistance within the isokinetic flow control module 5 is determined by the position of the valve adjustment shaft 110 within the PCFC unit 30 as described more fully below.

The difference between the first embodiment and the invention illustrated in FIG. 4A lies in the double rod cylinder 20. Referring again to FIG. 4A, the piston has a bottom rod 105 positioned beneath the piston 55. The length of the bottom rod 105 is substantially equal to the length of the cylinder, extending from the base of the cylinder 20 during the exercise stroke (see FIG. 4A) and being substantially encased within the cylinder 20 during the return stroke (see FIG. 4B). The introduction and withdrawal of the bottom rod 105 creates an equal volume of fluid 35 on either side of the piston 55 during the exercise and return strokes. The volume of this bottom rod 105 obviates the need for the accumulator 85 used in the first embodiment.

Referring again to FIG. 4B where the heavy arrows illustrate fluid flow during the return stroke, force on the user driven element 10 drives the top rod 60 into the cylinder 20. Fluid 35 beneath the piston 55 is forced through the lower port 50 of the cylinder 20 and into the hydraulic tubing 40 where it enters the PCFC unit 30. Fluid 35 flows into the manifold 65 and through the reverse flow check valve 70. This check valve 70 allows the fluid 35 to flow back into the space above the piston 55 within cylinder 20. As noted in the embodiment above, the reverse flow check valve 70 uses a spring-backed piston or similar mechanism that opens when pressurized fluid 35 enters the bottom of that valve 70.

Figure 5A:
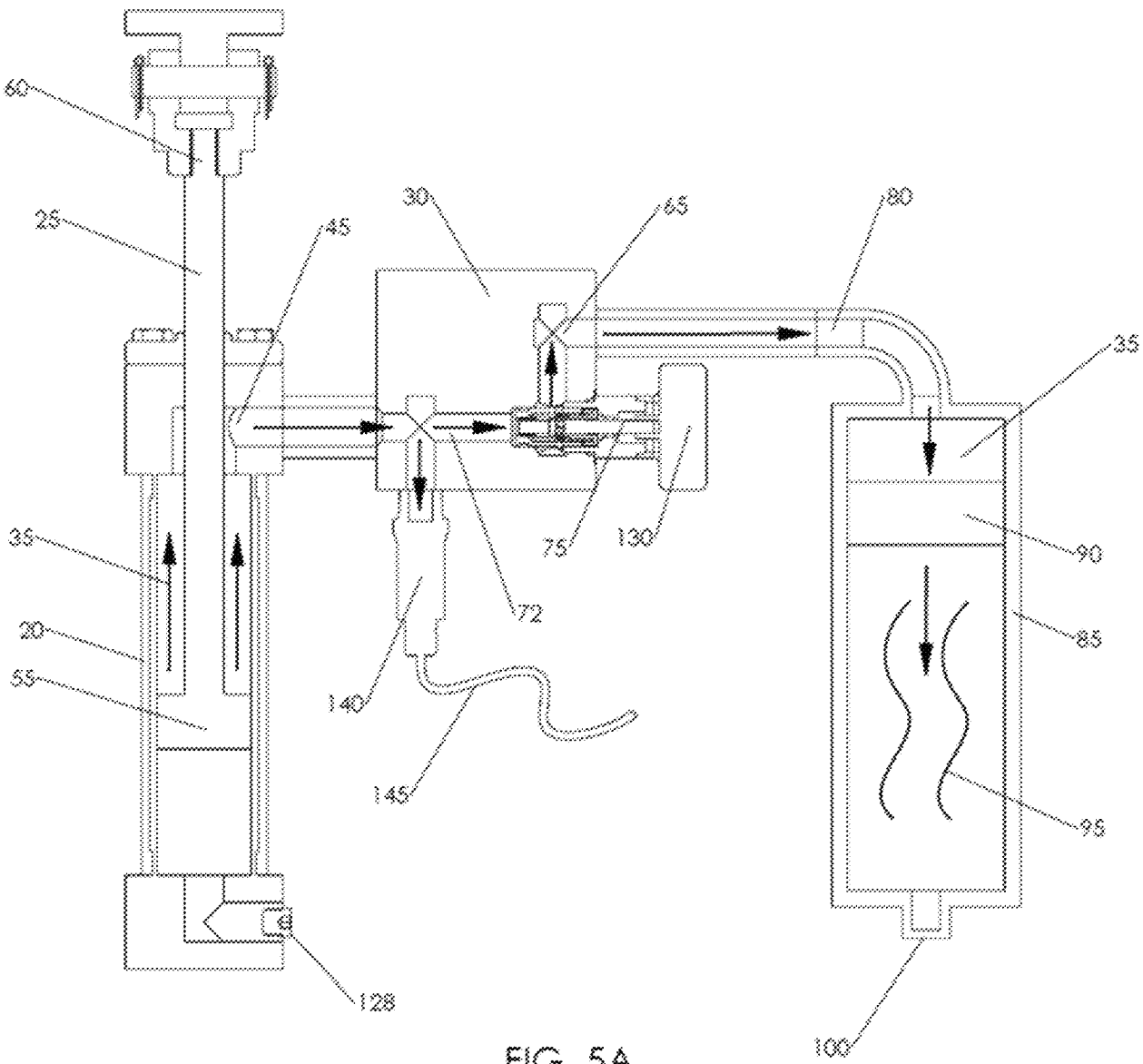
FIG. 5A is a detailed cross sectional view of the isokinetic flow control module during an exercise stroke wherein the cylinder has one port and a breather valve in lieu of two ports and a PCFC-RC valve in place of a reverse flow check valve.
Figure 5B:
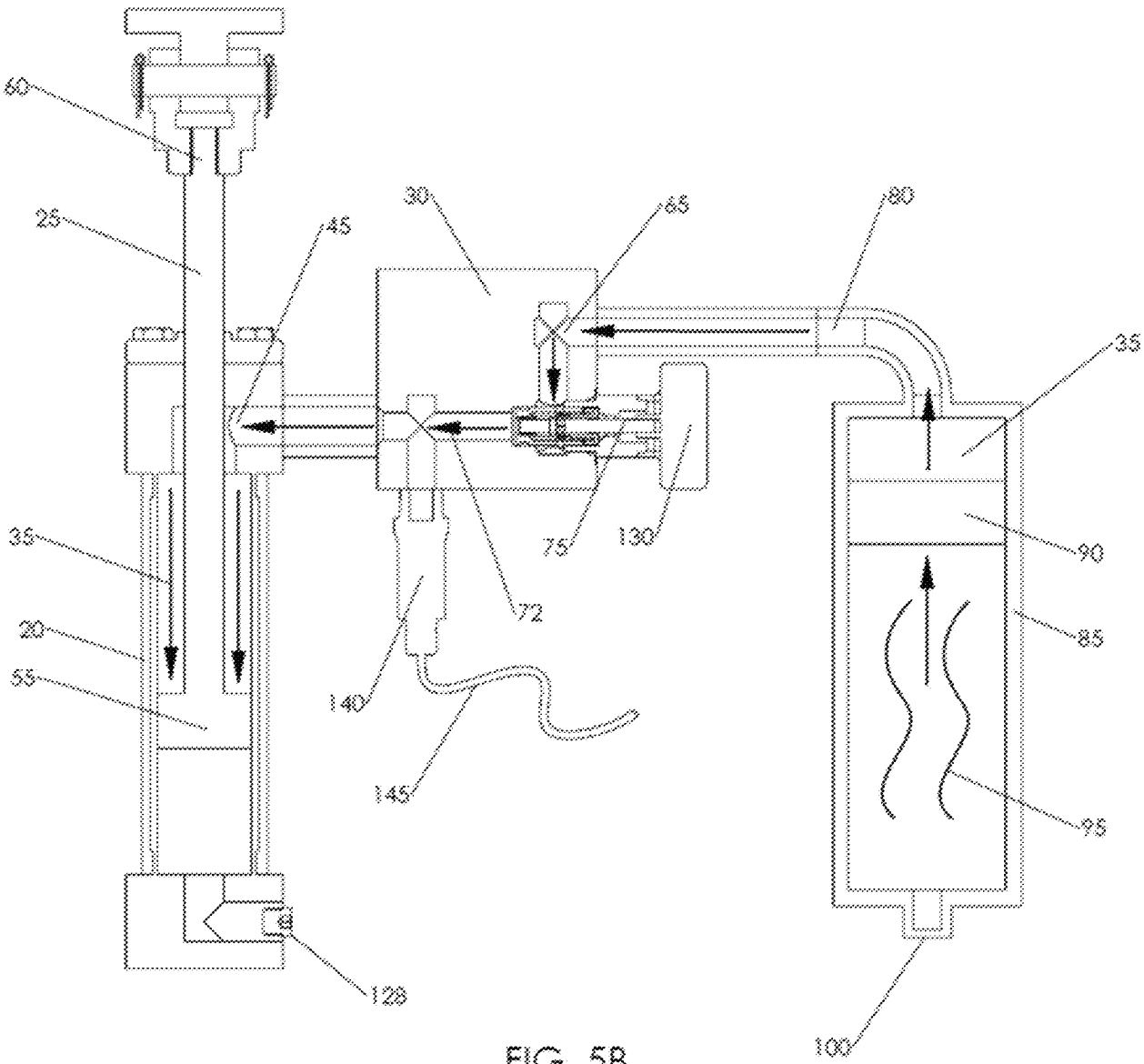
FIG. 5B is a detailed cross sectional view of the isokinetic flow control module during a return stroke wherein the cylinder has one port and a breather valve in lieu of two ports and a PCFC-RC valve in place of a reverse flow check valve.

FIGS. 5A and 5B depict yet another embodiment wherein the cylinder is comprised of a single port 45 and a breather valve 128 or similar component (hereinafter "breather valve"). This breather valve 128 allows air to enter and exit the space beneath the piston 55 to allow for movement of said piston 55 within the cylinder 20. Without a breather valve 128, the piston 55 would be vapor locked and unable to move. It should be noted that FIGS. 5A and 5B also illustrate the use of a PCFC-RC valve 75 in lieu of a distinct PCFC valve 75 and reverse flow check valve 70 within the PCFC unit 30.

Referring now to FIG. 5A, force on the user driven element 10 and connected piston 55 during the exercise stroke propels fluid 35 above the piston 55 up and out of the single port 45 of the cylinder 20 and into the PCFC valve inlet 72 of the PCFC unit 30. A check spool or sleeve within the PCFC-RC valve 75 remains closed allowing only a predetermined quantity of fluid 35 to flow through the PCFC-RC valve 75 at any given instant in time regardless of how hard the user pulls on the user driven element 10. This spool or sleeve has a corresponding spring that allows fluid 35 to move within the spool/sleeve. Fluid movement during the exercise stroke allows the spring to expand, pushing the spool or sleeve in position such that the fluid 35 is directed into the restriction mechanism 120 to regulate fluid speed as described more particularly below. Inventor has disclosed the use of a check spool or sleeve and corresponding spring but it should be understood that any similar directional flow device may be used within the PCFC-RC valve 75. Fluid 35 then exits the PCFC valve 75 and enters the manifold 65 where it then exits the PCFC unit 30 and enters the optional accumulator 85.

Referring now to FIG. 5B, force on the user driven element 10 and connected piston 55 during the return stroke pulls or draws fluid from the optional accumulator 85 into the PCFC unit 30 and manifold 65 and into the PCFC-RC valve 75. The reverse flow of fluid within the PCFC-RC valve 75 during this stroke compresses the spring thereby allowing fluid 35 to flow freely past the restriction mechanism 120 and through the PCFC-RC valve 75 with virtually no resistance. This, in turn, allows the piston 55 to return to the base of the cylinder 20 more quickly in preparation for the next exercise cycle. While not depicted in FIGS. 5A and 5B, it should be understood that a separate reverse flow check valve 70 may also be added to a PCFC-RC valve 75, as intimated in FIGS. 3A-4B, to further increase the rate of return of the piston 55.

Figure 6A:
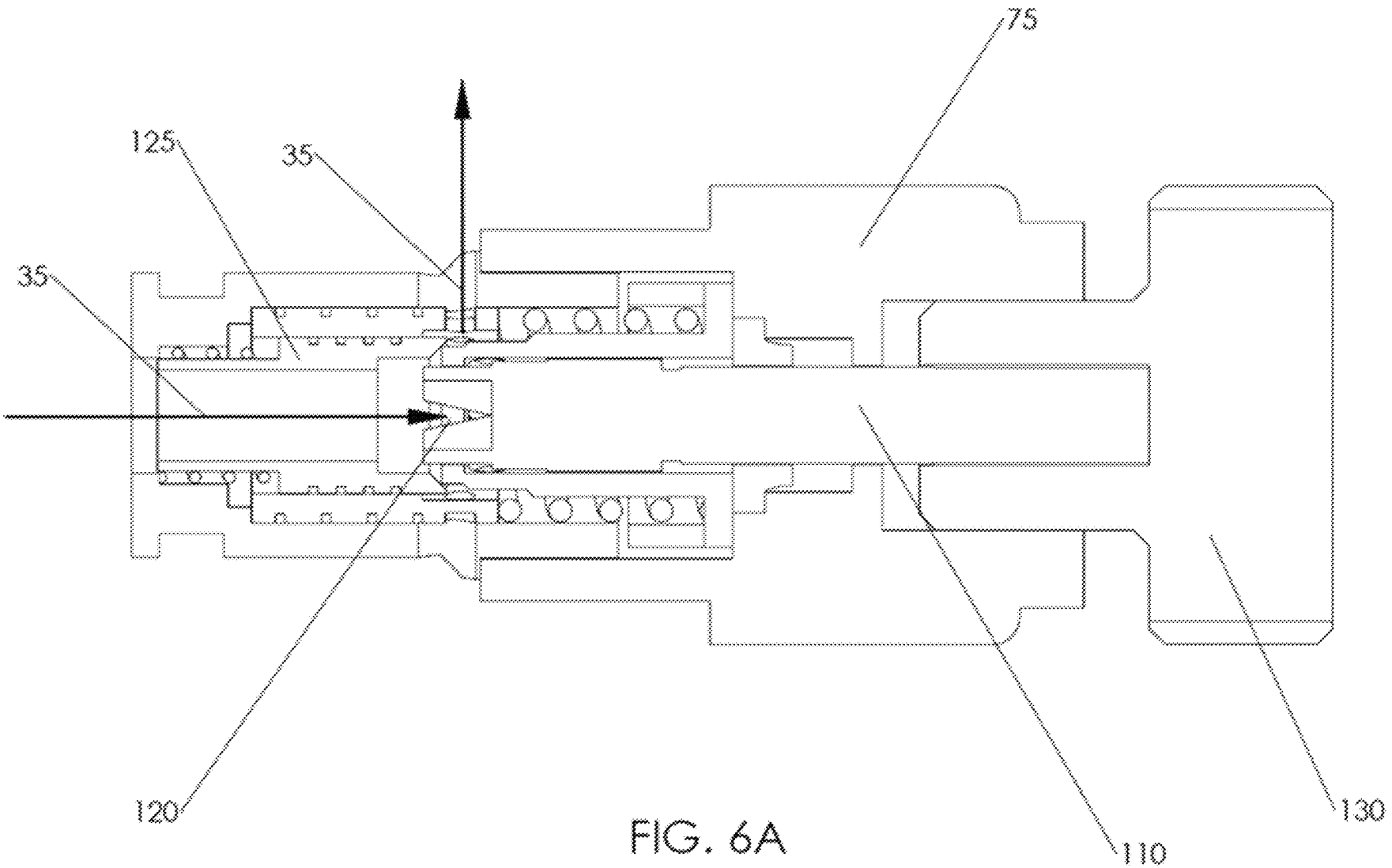
FIG. 6A is a cross-sectional view of the PCFC valve where the arrows illustrate the fluid flow along with the various components within the valve body.
Figure 6B:
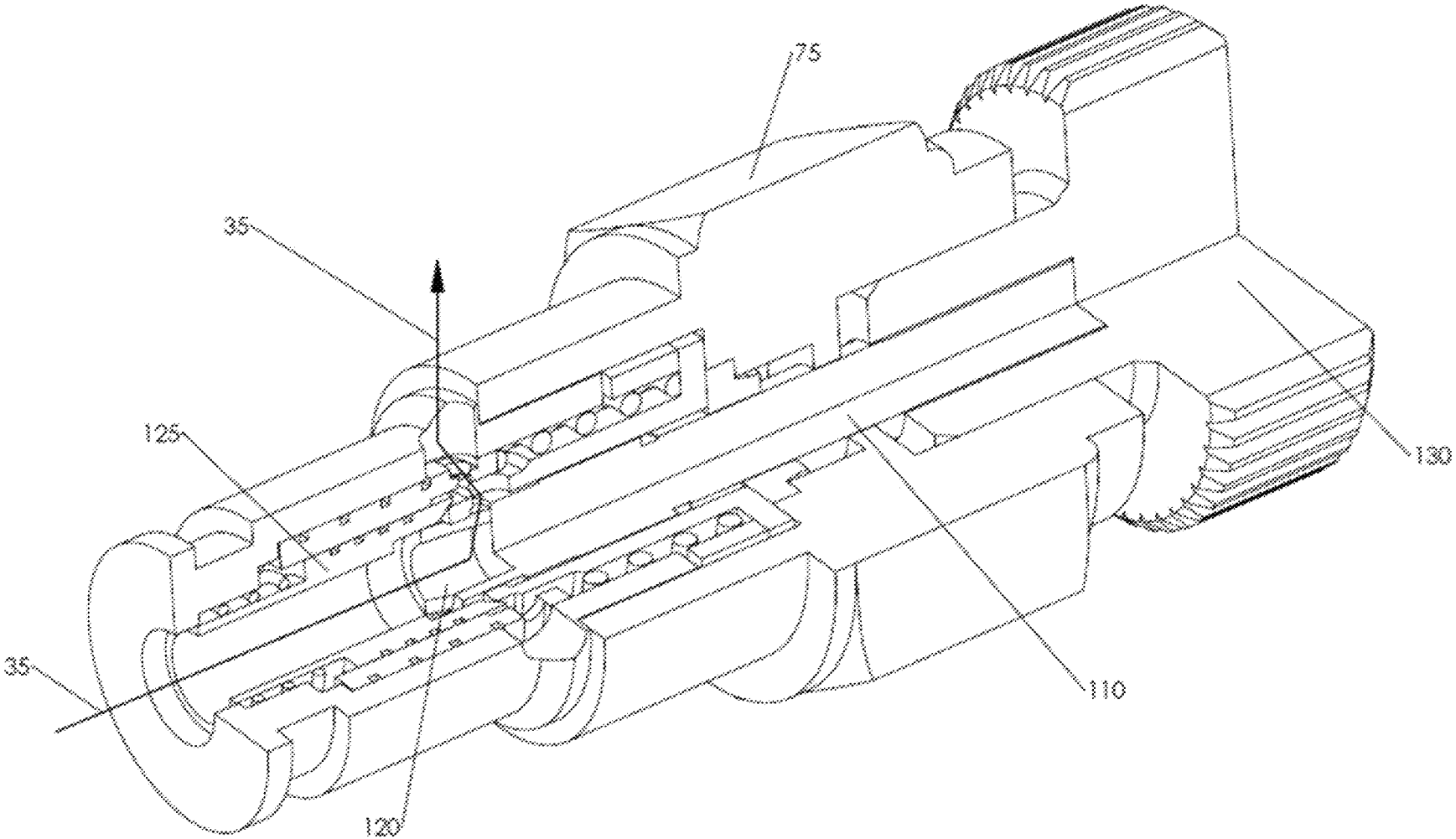
FIG. 6B is a perspective view of the PCFC valve where the arrows illustrate the fluid flow through the restriction mechanism and into the body of the valve.
Figure 7A:
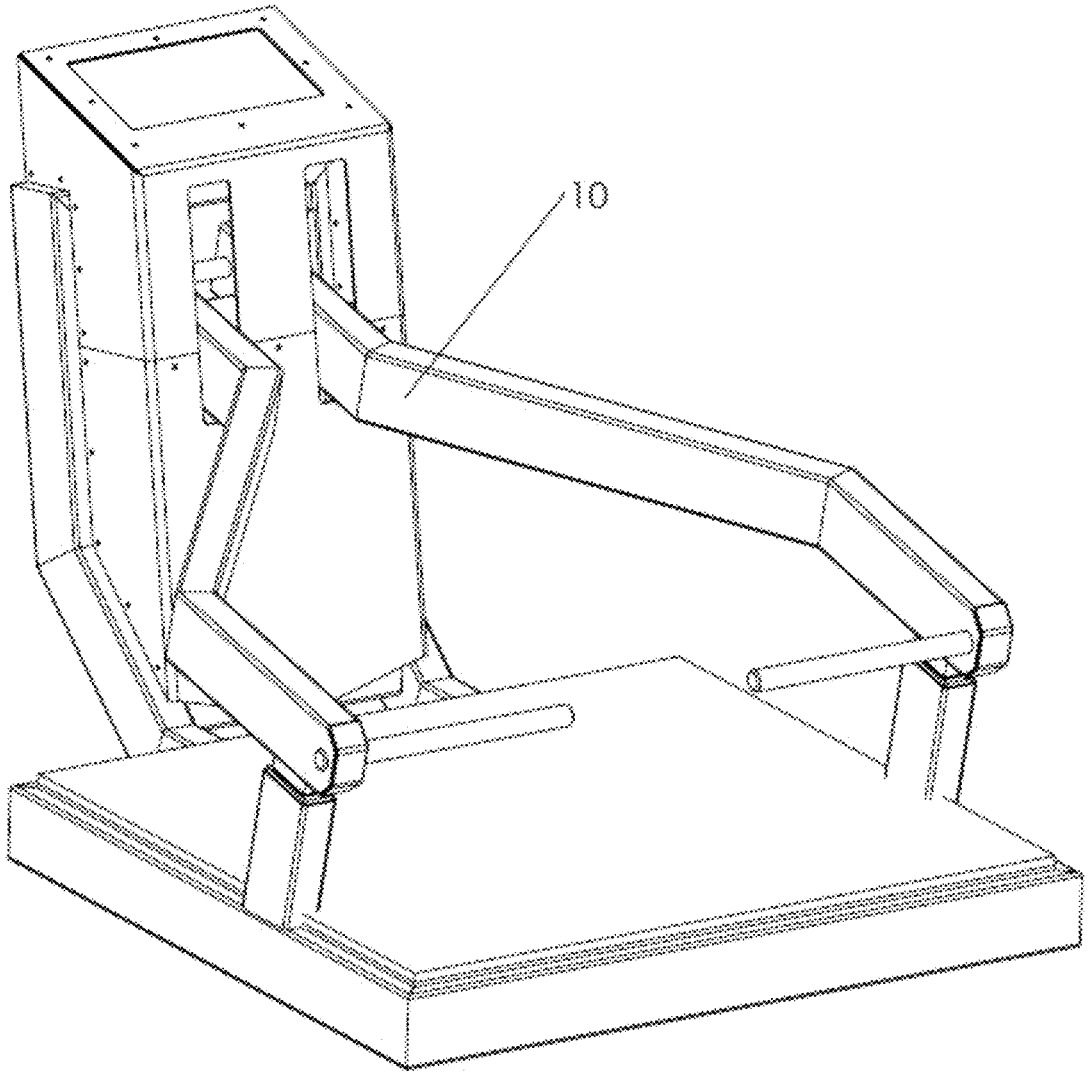
FIG. 7A is a perspective front view of a dead lift machine.
Figure 7B:
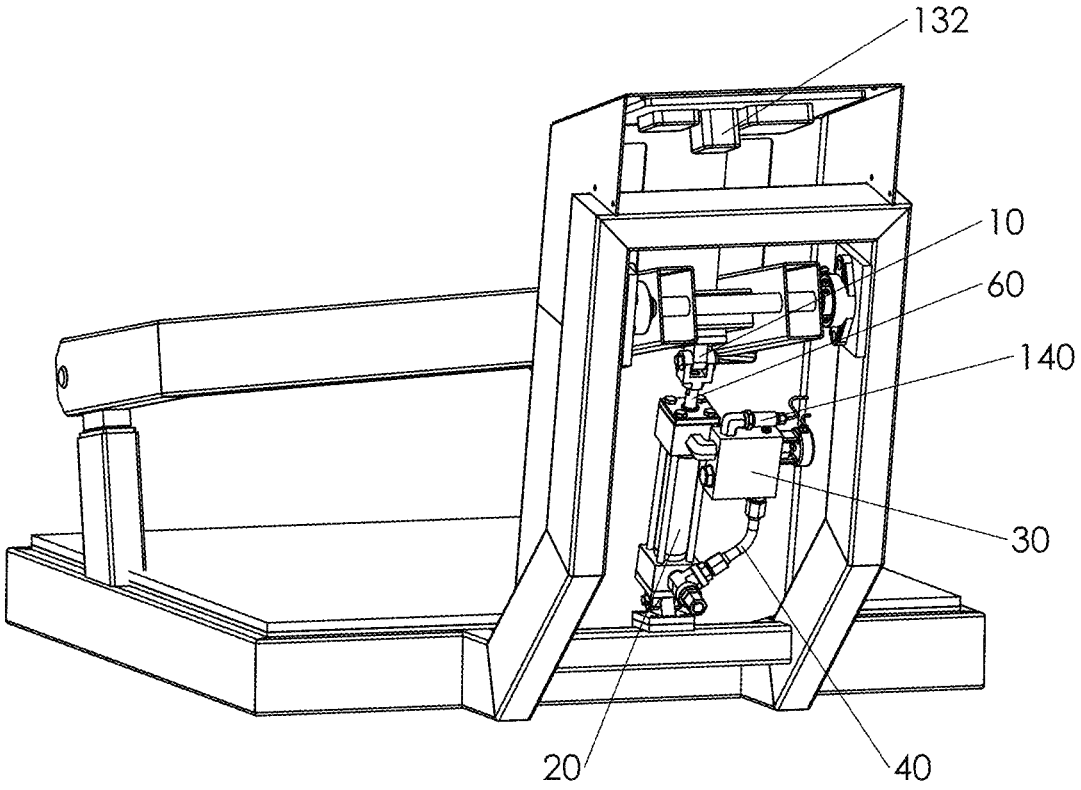
FIG. 7B is a perspective rear view of the dead lift machine depicted in FIG. 7A having an isokinetic closed loop hydraulic flow control module connected to the user driven element of the machine.

In each embodiment, the user selects a desired flow rate corresponding to the desired difficulty level of the exercise prior to starting their workout. The bold arrows in FIGS. 6A and 6B illustrate fluid flow through the PCFC valve 75 during each exercise stroke. Once fluid 35 enters the PCFC valve 75, it passes through a restriction mechanism 120 such as the v-notch shown in FIGS. 6A and 6B. This restriction mechanism acts as an adjustable orifice. The fluid flow rate is governed by the position of the valve adjustment shaft 110 illustrated in FIGS. 6A and 6B. As the valve adjustment shaft 110 advances, the restriction mechanism 120 opens, increasing the flow rate of the fluid 35 and allowing the user to exercise at a reduced speed and less intense workout. When the adjustment shaft 110 is retracted, the restriction mechanism 120 closes and constricts the fluid flow, offering the user a slower flow rate and more strenuous workout. The position of the valve adjustment shaft 110 can be modified by moving a speed adjustment mechanism 130 illustrated in FIGS. 6A and 6B. This speed adjustment mechanism 130 can be manually adjusted or it may be altered using a selector mechanism such as a rack and pinion control cable or by selecting specific or preset speeds on a touch screen 135. This touch screen 135 may be electronically configured to rotate a motor controller coupled to the speed adjustment mechanism 130 or directly to the valve adjustment shaft 110.

Once the flow rate has been selected and the athlete applies force to the user driven element 10 during the exercise stroke, fluid 35 flows in at the inlet 72 of the PCFC valve 75. Referring to FIGS. 6A and 6B, flow through the restriction mechanism 120 creates a fixed pressure drop which governs the rate of flow up into the valve body. As flow at the inlet 72 increases, a compensator spool 125 shifts to cover a portion of the restriction mechanism 120. This shift is what maintains the fixed pressure drop and consistent flow rate within the PCFC valve 75. Conversely, as the flow at the inlet 72 decreases, the compensator spool 125 shifts again to expose more cross-sectional area on the restriction mechanism 120. The dynamic shifting of the compensator spool 125 works in combination with the remaining elements of the flow control module 5 to create the isokinetic nature of the present invention.

In embodiments where a PCFC-RC valve is used, the valve further includes a check spool and sleeve and corresponding spring that opens only in one direction of fluid flow to bypass the restriction mechanism 120. The opening of the check spool or sleeve allows unrestricted fluid flow within the system as a constant flow is not required in this stroke. See FIG. 5B. In embodiments using a standard PCFC valve 75 in combination with a reverse flow check valve 70 such as that shown in FIGS. 3B-4B, fluid bypasses the PCFC valve 75 altogether. The reverse flow check valve 70 opens and similarly allows free flow of fluid 35 within the closed loop system. See FIGS. 3B and 4B.

Figure 11A:
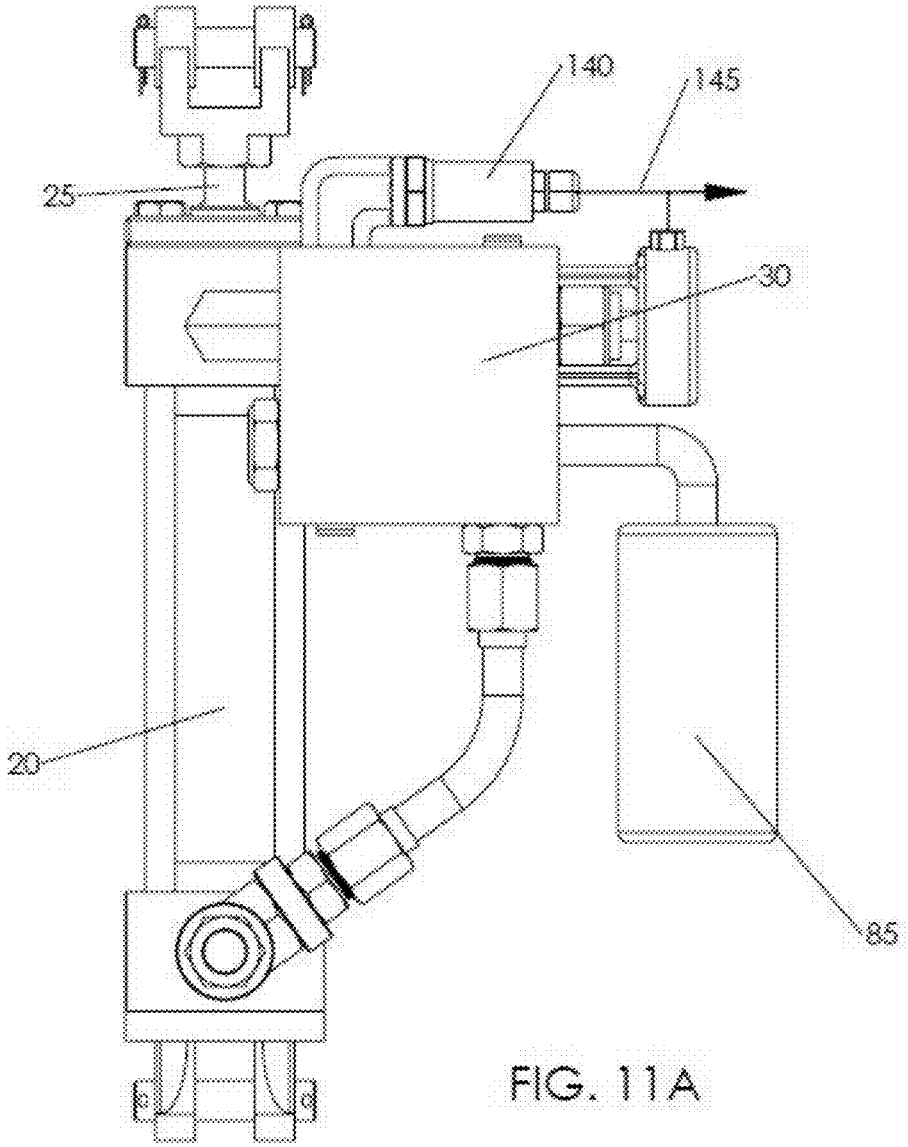
FIG. 11A illustrates the flow of data from the pressure transducer to the display.
Figure 11B:
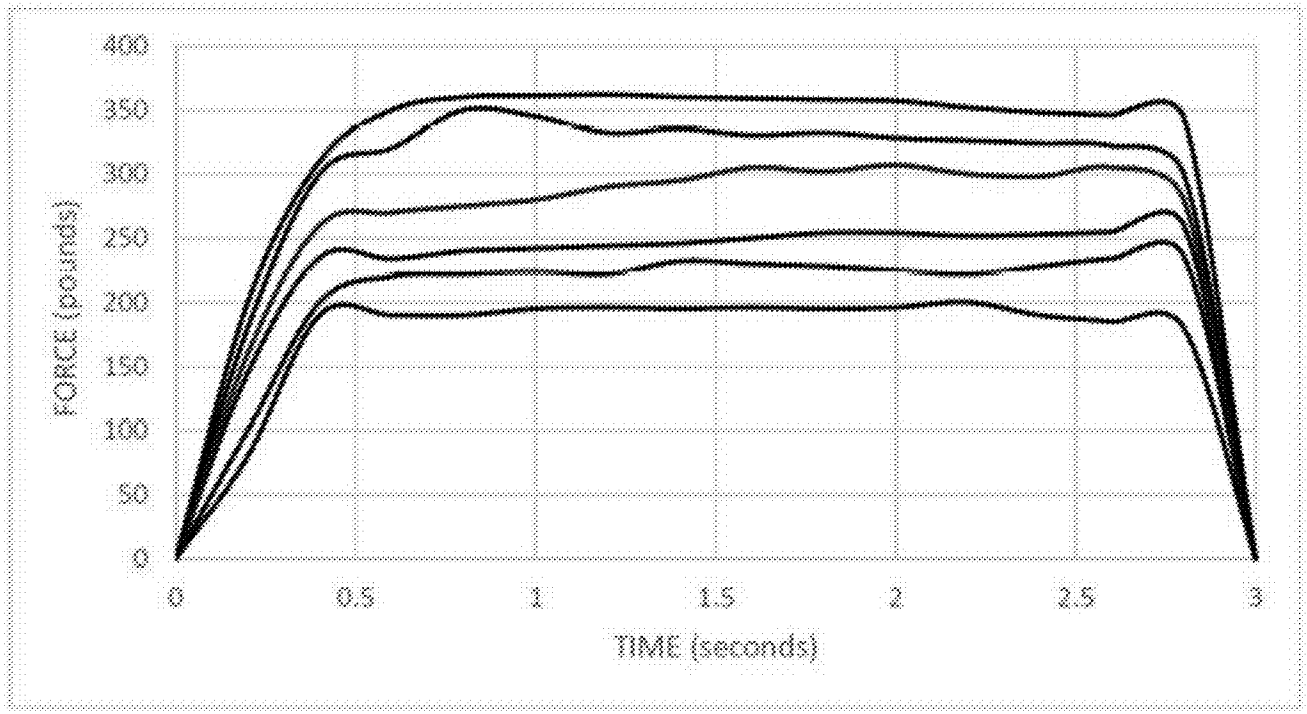
FIG. 11B illustrates a sample user display

The pressure within the PCFC valve inlet 72 may be read by an optional pressure transducer 140 in fluid communication with said inlet 72. The pressure transducer 140 may alternatively be positioned prior to the manifold 65 near the PCFC valve exit or within the cylinder 20. See FIGS. 3A, 3B, 4A, and 4B. The pressure transducer 140 sends a signal with the pressure reading either through a wireless or direct electrical connection 145 to a DAQ 150 as illustrated in FIG. 11A. This data can be stored and manipulated by a computer and sent to a display such as a touch screen 135 or smart device, if desired. Each exercise stroke may be plotted as an individual graphical display of force over time. As the pressure falls below a preset "low value" the computer interprets this as the beginning of a new exercise stroke and the subsequent data may be plotted as a different color such that each repetition is visually illustrated in a different hue. This allows the athlete to view their performance more easily with each repetition as shown in FIG. 11B. Control valve speed (which is directly related to the level of difficulty of the workout), maximum force applied, average force applied, caloric expenditure, and other pertinent metrics related to user force exerted over time may also be displayed on the user interface 135.

As previously noted, the present invention 5 may be incorporated or retrofitted into a variety of exercise machines. FIGS. 1A, 1B, 7A and 7B show the front and reverse of a standard dead lift machine wherein the flow control mechanism 5 is connected to a point (yoke) along the user driven element 10, allowing the hydraulic piston unit 25 to extend and retract with each respective exercise and return stroke.

Figure 8A:
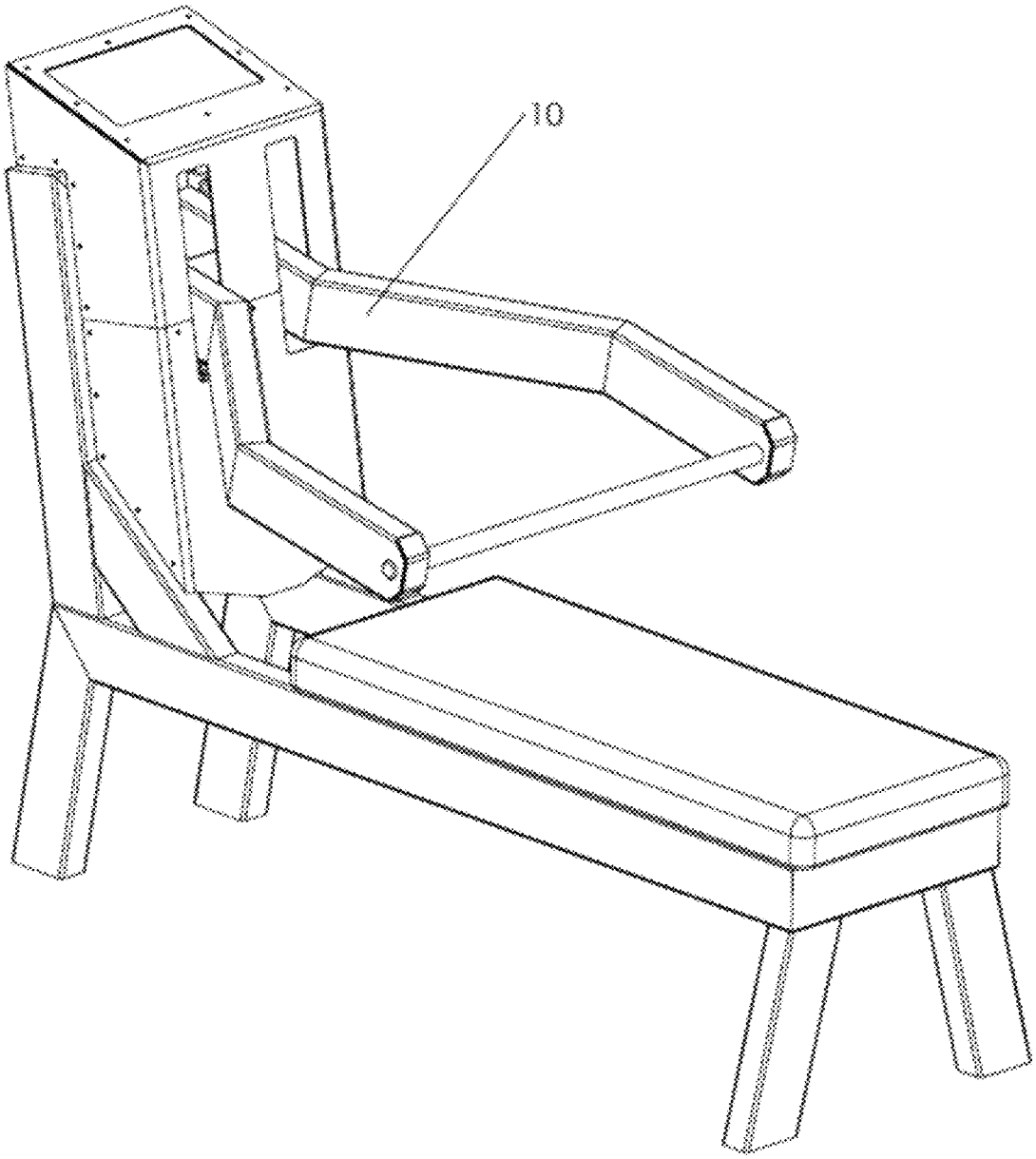
FIG. 8A is a perspective front view of a bench press.
Figure 8B:
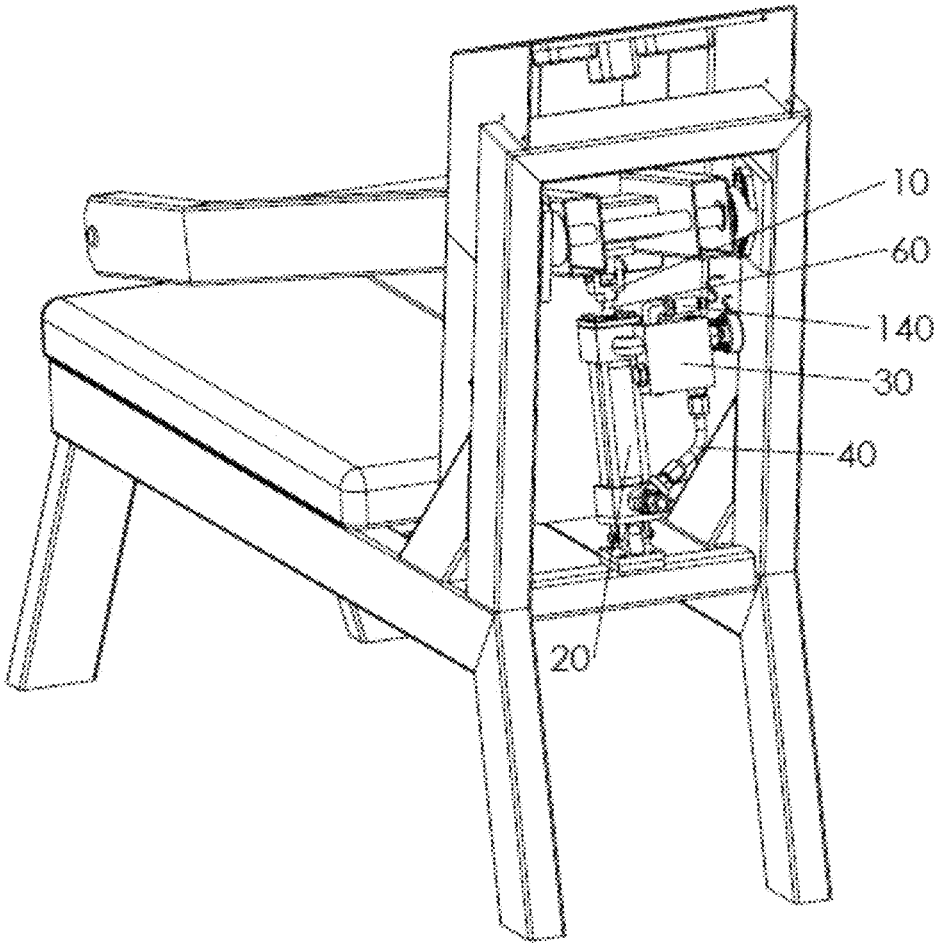
FIG. 8B is a perspective rear view of the bench press depicted in FIG. 8A having an isokinetic closed loop hydraulic flow control module connected to the user driven element (lifting bar) of the machine.

FIGS. 8A and 8B illustrate the front and rear of a bench press machine, respectively. Referring now to FIG. 8B, the top rod 60 of hydraulic piston unit 25 is similarly affixed to user driven element 10 (lifting bar or arm) allowing said piston 20 to extend and retract during the exercise and return strokes.

Figure 9A:
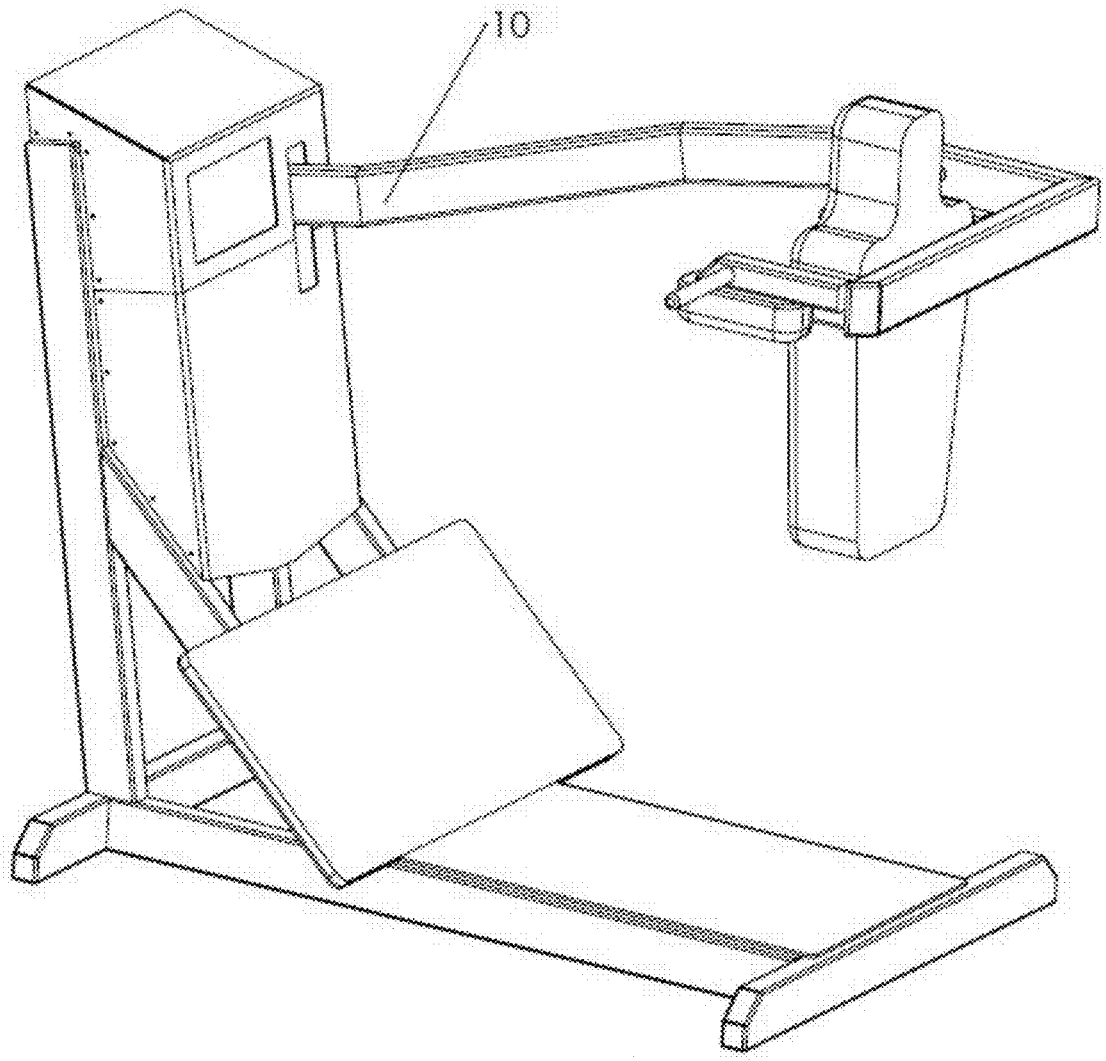
FIG. 9A is a perspective front view of a squat machine.
Figure 9B:
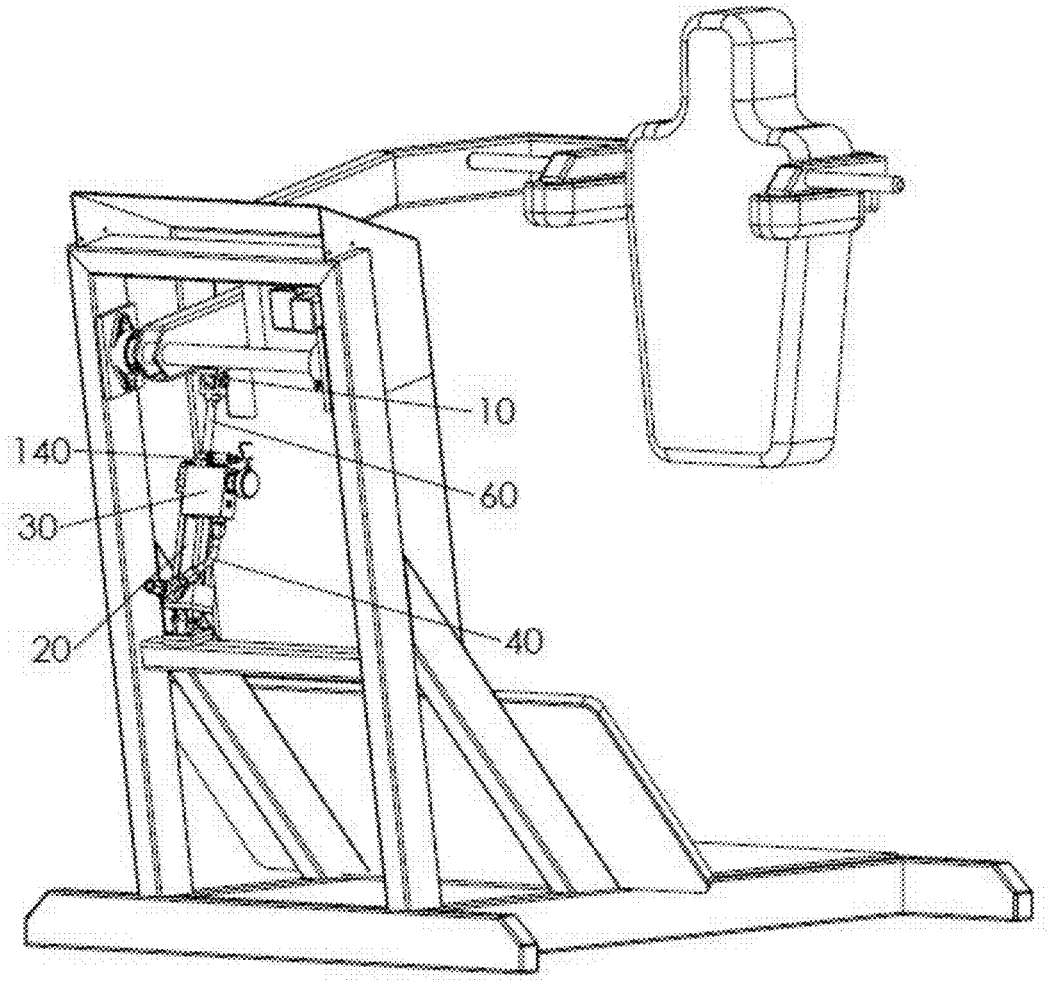
FIG. 9B is a perspective rear view of the squat machine depicted in FIG. 9A having an isokinetic closed loop hydraulic flow control module connected to the user driven element (lifting bar) of the machine.

FIGS. 9A and 9B illustrate the front and rear of a squat machine. Again, the top rod 60 of the hydraulic piston unit 25 is affixed to the user driven element 10 which in this case is comprised of a large arm connected to two hand grips. As the exerciser lowers and raises his body, the hydraulic piston unit 25 extends and retracts within the hydraulic cylinder 20.

Figure 10A:
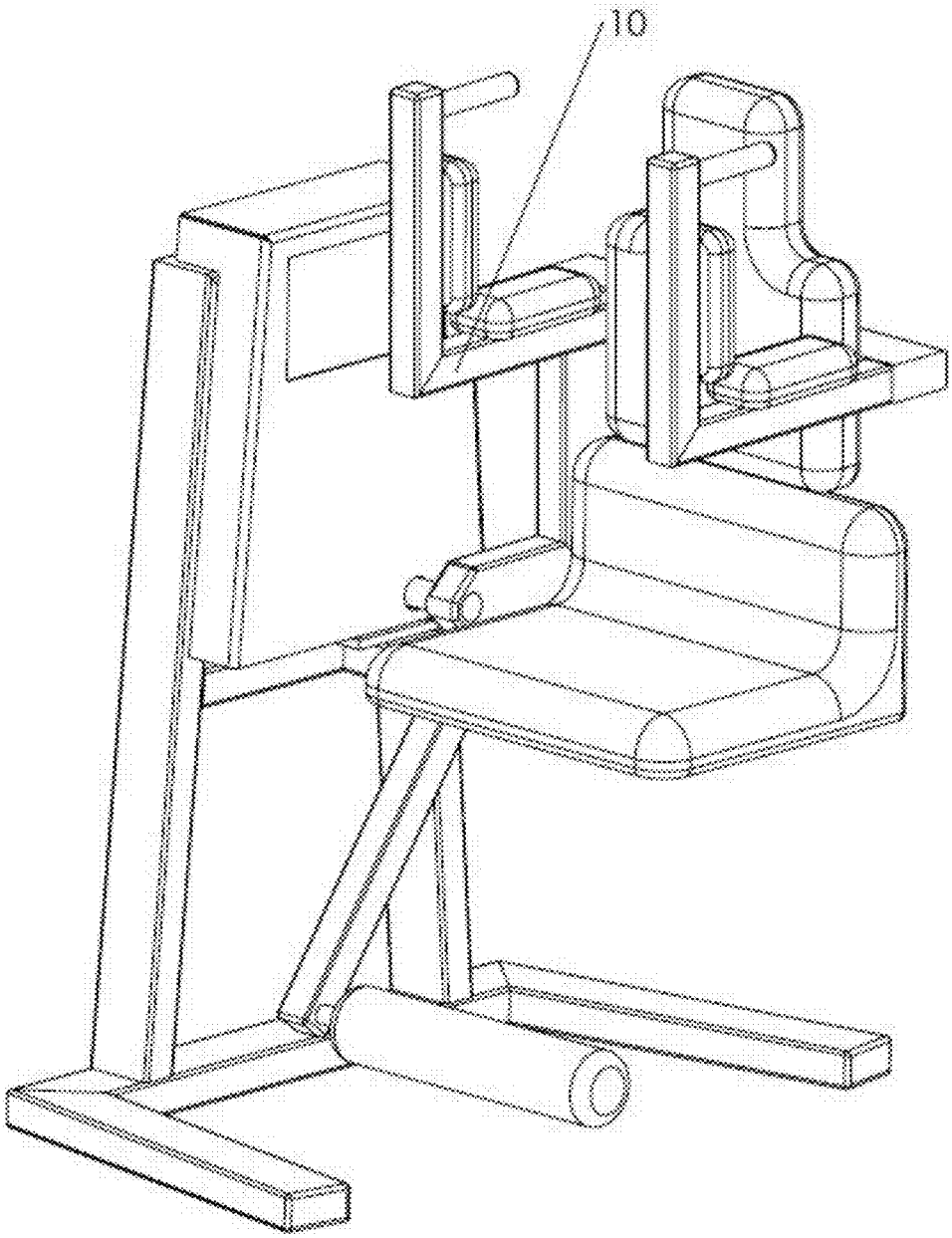
FIG. 10A is a perspective front view of an abdominal machine.
Figure 10B:
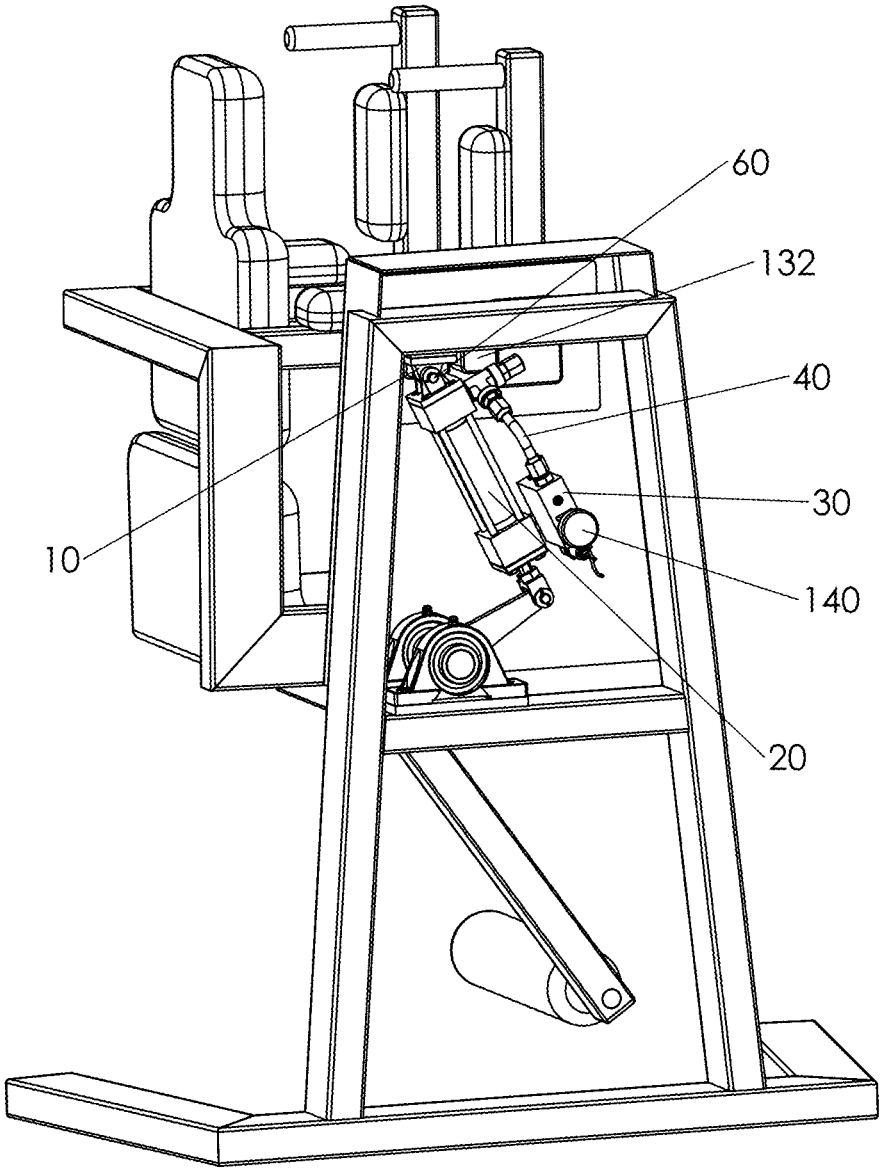
FIG. 10B is a perspective rear view of an abdominal machine depicted in FIG. 10A having an isokinetic closed loop hydraulic flow control module connected to the user driven element (leg bar) on the machine.

The top rod 60 of the hydraulic piston unit 25 is similarly affixed to the user driven element 10 of the abdominal machine shown in FIGS. 10A and 10B. During the exercise stroke, the athlete rotates the hand grips downward, pushing the top rod 60 into the cylinder 20, thereby pulling fluid 35 from the lower port 50 of the hydraulic cylinder 20 and into the PCFC unit 30.

The above mentioned examples have been included to illustrate the adaptable nature of the isokinetic flow control module 5. The present invention may be used within a variety of exercise equipment; subsequently, the position of said module 5 will depend on the location of the user driven element 10 on any given piece of equipment. Similarly, the direction flow within the closed loop hydraulic system will also depend on the placement and connection of individual components within that system.

While the above description contains many specifics, these should be considered exemplifications of one or more embodiments rather than limitations on the scope of the invention. As previously discussed, many variations are possible and the scope of the invention should not be restricted by the examples illustrated herein.

The invention claimed is:

1. An apparatus for maintaining a constant speed and user-generated resistance within exercise equipment, the apparatus comprising:

a. a closed loop hydraulic system comprised of a piston moveably seated within a cylinder and in fluid communication with a pressure compensating unit, wherein a bottom rod is positioned beneath the piston and extends out from a bottom of the cylinder;

b. wherein the cylinder further comprises at least one port to facilitate fluid flow within the closed loop hydraulic system;

c. wherein the pressure compensating unit is comprised of a reverse flow check device and a pressure compensating flow control valve (PCFC valve) comprising a valve adjustment shaft mechanically connected to a speed adjustment mechanism, and wherein said reverse flow check device is integral to or in fluid communication with the PCFC valve;

d. wherein the piston is mechanically fastened to a user driven element on a piece of exercise equipment having an exercise stroke and a return stroke and wherein movement of said piston imparts a force that results in an increase or decrease in pressure within the closed loop hydraulic system;

e. wherein the PCFC valve responds to the increase or decrease in pressure within the closed loop hydraulic system such that a constant fluid flow rate is maintained within said closed loop hydraulic system during the exercise stroke, subsequently allowing or inhibiting the motion of the user driven element to maintain a constant speed;

f. wherein the reverse flow check device allows unrestricted fluid flow within the closed loop hydraulic system during the return stroke; and g. wherein the apparatus further comprises a display screen, a pressure transducer, and a data acquisition device in digital communication with a computer, wherein said pressure transducer transmits data pertaining to a force exerted by a user on the user driven element over a time period to complete each exercise stroke to the data acquisition device and the computer, wherein said computer calculates statistical information pertaining to the movement of the user driven element over time, and wherein said statistical information is transmitted and displayed on said display screen in data or graphical form.

2. The apparatus of claim 1, wherein the speed adjustment mechanism is connected to a motor such that a position of the speed adjustment mechanism is electronically controlled through a wireless or direct electrical connection with said motor.

3. The apparatus of claim 1, further comprising a touch screen in electronic communication with the speed adjustment mechanism, wherein a specific or preset speed is selected from said touch screen to adjust a position of the speed adjustment mechanism.

4. A method for providing constant speed and user-generated resistance within a piece of exercise equipment, said method comprising:

a. selecting a piece of exercise equipment having a user driven element comprised of one or more lifting bars or arms for exercising targeted muscle groups during an exercise stroke wherein each bar or arm returns to a home position during a return stroke;

b. providing a flow control mechanism comprised of a closed loop hydraulic system, said closed loop hydraulic system being comprised of a piston moveably seated within a cylinder having at least one port in fluid communication with a pressure compensating unit, wherein a bottom rod is positioned beneath the piston and extends out from a bottom of the cylinder, wherein the pressure compensating unit is comprised of a reverse flow check device and a pressure compensating flow control valve (PCFC valve), wherein the PCFC valve is comprised of a valve adjustment shaft mechanically connected to a speed adjustment mechanism, wherein said reverse flow check device is integral to or in fluid communication with the PCFC valve, wherein the PCFC valve responds to an increase or decrease in pressure within the closed loop hydraulic system by maintaining a constant speed of the user driven element during the exercise stroke regardless of a force applied by a user to the user driven element, wherein the reverse flow check device allows unrestricted flow within the closed loop hydraulic system during the return stroke; and wherein the closed loop hydraulic system further comprises a pressure transducer electronically connected to a data acquisition device and a computer, wherein said computer is electronically connected to a display screen;

c. mechanically fastening the piston to the user driven element;

d. measuring, via the pressure transducer, the force applied over a time period the force is applied and generating force over time data;

e. transmitting the force over time data to the data acquisition device and the computer;

f. calculating, by the computer, statistical data sets based on the force over time data; and g. displaying, on the display screen, the statistical data sets as discrete data points or graphical representations of that data.

5. The method of claim 4, comprising the additional steps of:

h. electronically connecting the speed adjustment mechanism to a motor; and k. controlling a position of the speed adjustment mechanism through a wireless or direct electrical connection to said motor.

* * * * *